US012102240B2

(12) United States Patent
Mao

(10) Patent No.: US 12,102,240 B2
(45) Date of Patent: Oct. 1, 2024

(54) PORTABLE CHILD GAME BED

(71) Applicant: ANHUI COOLBABY SCIENCE & TECHNOLOGY DEVELOPMENT CORPORATION, Anhui (CN)

(72) Inventor: Hongyong Mao, Anhui (CN)

(73) Assignee: ANHUI COOLBABY SCIENCE & TECHNOLOGY DEVELOPMENT CORPORATION, Anhui (CN)

( * ) Notice: Subject to any disclaimer, the term of this patent is extended or adjusted under 35 U.S.C. 154(b) by 271 days.

(21) Appl. No.: 17/638,662

(22) PCT Filed: Jan. 27, 2021

(86) PCT No.: PCT/CN2021/073970

§ 371 (c)(1),
(2) Date: Feb. 25, 2022

(87) PCT Pub. No.: WO2021/196847

PCT Pub. Date: Oct. 7, 2021

(65) Prior Publication Data

US 2022/0296007 A1 Sep. 22, 2022

(30) Foreign Application Priority Data

Mar. 31, 2020 (CN) ..... 202010240039.6

(51) Int. Cl.
*A47D 13/06* (2006.01)
*A47D 7/00* (2006.01)

(52) U.S. Cl.
CPC ..... *A47D 13/063* (2013.01); *A47D 7/002* (2013.01)

(58) Field of Classification Search
CPC ..... A47D 13/061; A47D 13/063
See application file for complete search history.

(56) References Cited

U.S. PATENT DOCUMENTS 4,739,527 A * 4/1988 Kohus ..... A47D 13/066 5/99.1
5,241,716 A 9/1993 Kohus
(Continued)

FOREIGN PATENT DOCUMENTS

CN 101674759 A 3/2010
CN 103330423 A 10/2013
(Continued)

OTHER PUBLICATIONS

International Search Report mailed Apr. 16, 2021, issued in the correspond PCT Application No. PCT/CN2021/073970, filed Jan. 27, 2021, along with an English translation.
(Continued)

*Primary Examiner* — Eric J Kurilla
(74) *Attorney, Agent, or Firm* — Perry + Currier Inc.

(57) ABSTRACT

Disclosed is portable child game bed, including bed legs and folding driving device. Guard bars are respectively arranged at tops between every two adjacent bed legs, two ends of guard bar are respectively movably connected to tops of corresponding bed legs, connecting mechanism is arranged at bottom of each bed leg, connecting rod is composed of upper connecting rod and lower connecting rod that are vertically arranged, connecting mechanism comprises base and transmission mechanism, one end of upper connecting rod is connected to base, the other end of upper connecting rod is rotationally connected to frame body, one end of lower connecting rod is rotationally connected to base, the end of lower connecting rod that extends into inner cavity of lower portion of base is linked together with transmission mechanism, and the other end of lower connecting rod is rotationally connected to frame body.

17 Claims, 24 Drawing Sheets

(56) References Cited

U.S. PATENT DOCUMENTS

| | | | | |
|---|---|---|---|---|
| 7,694,361 | B1 * | 4/2010 | Chen | A47D 13/063 5/98.1 |
| 7,836,530 | B2 * | 11/2010 | Thorne | A47D 13/063 5/98.1 |
| 11,363,893 | B2 * | 6/2022 | Thorne | A47D 13/061 |
| 11,589,685 | B2 * | 2/2023 | Bastien | A47D 13/063 |
| 11,723,478 | B2 * | 8/2023 | Juchniewicz | A47D 9/005 5/98.1 |
| 2012/0266381 | A1 | 10/2012 | Thorne et al. | |
| 2013/0240815 | A1 * | 9/2013 | Wiegmann | A47D 13/061 256/25 |
| 2017/0290444 | A1 * | 10/2017 | Mao | A47D 13/063 |
| 2018/0168365 | A1 * | 6/2018 | Huang | A47D 7/002 |
| 2020/0281369 | A1 * | 9/2020 | Juchniewicz | A47D 7/002 |
| 2022/0087445 | A1 * | 3/2022 | Tan | A47D 13/063 |
| 2023/0031002 | A1 * | 2/2023 | Mountz | A47D 13/063 |

FOREIGN PATENT DOCUMENTS

| | | | | | |
|---|---|---|---|---|---|
| CN | 103349455 | A | | 10/2013 | |
| CN | 203424657 | U | | 2/2014 | |
| CN | 103908117 | A | * | 7/2014 | |
| CN | 103989355 | A | * | 8/2014 | A47D 13/063 |
| CN | 104323625 | A | | 2/2015 | |
| CN | 104545130 | A | | 4/2015 | |
| CN | 104757823 | A | | 7/2015 | |
| CN | 104771017 | A | | 7/2015 | |
| CN | 104983230 | A | * | 10/2015 | |
| CN | 206044116 | U | | 3/2017 | |
| CN | 107048833 | A | | 8/2017 | |
| CN | 108209318 | A | * | 6/2018 | A47D 13/00 |
| CN | 108209331 | A | * | 6/2018 | A47D 13/00 |
| CN | 108371449 | A | * | 8/2018 | A47D 7/002 |
| CN | 208048460 | U | * | 11/2018 | A47D 13/061 |
| CN | 208048461 | U | | 11/2018 | |
| CN | 208048470 | U | * | 11/2018 | A47D 13/00 |
| CN | 109619911 | A | * | 4/2019 | A47D 13/061 |
| CN | 110236327 | A | * | 9/2019 | |
| CN | 209421520 | U | | 9/2019 | |
| CN | 210008776 | U | | 2/2020 | |
| CN | 210144293 | U | | 3/2020 | |
| CN | 111214041 | A | * | 6/2020 | A47D 7/002 |
| CN | 111358228 | A | | 7/2020 | |
| CN | 111358229 | A | * | 7/2020 | A47D 7/002 |
| CN | 111419039 | A | | 7/2020 | |
| CN | 112294031 | A | * | 2/2021 | A47D 13/061 |
| CN | 111419038 | B | * | 8/2021 | A47D 13/061 |
| CN | 115281491 | A | * | 11/2022 | |
| CN | 109380919 | B | * | 8/2023 | A47D 13/065 |
| CN | 219845780 | U | * | 10/2023 | |
| CN | 117045076 | A | * | 11/2023 | |
| CN | 117356874 | A | * | 1/2024 | |
| TW | M539289 | U | * | 4/2017 | |
| TW | 202033137 | A | * | 9/2020 | A47D 13/063 |
| TW | 202131834 | A | * | 9/2021 | A47D 13/063 |
| WO | 2018008056 | A1 | | 11/2018 | |
| WO | WO-2020143623 | A1 | * | 7/2020 | A47D 13/061 |

OTHER PUBLICATIONS

First Office Action issued in corresponding Chinese Application No. 202010240039.6, filed Mar. 31, 2020, along with an English translation.

Notification to Grant Patent Right for Invention for Chinese Application No. 202010240039.6, filed Mar. 31, 2020, along with an English translation.

First search of priority document 2020102400396.

Supplementary search of priority document 2020102400396.

* cited by examiner

PORTABLE CHILD GAME BED

TECHNICAL FIELD

The present application relates to the technical field of producing a child game bed, and in particular, to a portable child game bed.

BACKGROUND ART

An existing structure is disclosed by Chinese patent application with the application number of CN201310306550.1, entitled as "Child Entertainment Bed", with the structure comprising four supporting legs and a bottom central control device. Each of the supporting legs has the lower inner side hinged to an upper connecting rod and a lower connecting rod. An upper supporting beam is pivotally arranged between the upper ends of the two adjacent supporting legs, and the middle part of the upper supporting beam is provided with a cross beam folding joint. An upper folding mechanism is provided between the supporting leg and the upper supporting beam, and a lower folding mechanism is provided between the outer ends of the upper connecting rod and the lower connecting rod. The inner ends of the upper connecting rod and the lower connecting rod are connected to the bottom central control device and driven by the bottom central control device to fold and unfold. The cross beam folding joint, the lower folding mechanism, and the upper folding mechanism are all driven to fold and unfold by the upper connecting rod and the lower connecting rod. The purpose of the application is to overcome the shortcomings of the prior art and provide a child entertainment bed with good stability and convenient folding and unfolding operations. The disadvantage of this structure is that the child entertainment bed needs to be provided with a total of 24 pull ropes, including the unfolding pull ropes, the folding pull ropes, and beam pull ropes, and thus the manufacturing process is too complicated.

SUMMARY

The technical problem to be solved by the present application is to provide a portable child game bed with ingenious and firm structure, flexible and convenient use, and low production cost in view of the above-mentioned existing state of the prior art.

The technical solutions adopted by the present application to solve the above technical problems are as follows. The portable child game bed comprises four bed legs and a folding driving device which is placed in a middle part of a bottom of the bed and capable of folding and unfolding a bed body, wherein guard rods are respectively arranged at tops between adjacent two bed legs with each of the guard rods having a middle part foldable; two ends of each of the guard rods are respectively movably connected to tops of corresponding bed legs; a connecting mechanism is provided at a bottom of each of the bed legs with the connecting mechanism movably connected with a folding driving device through connecting rods; the connecting rod is composed of an upper connecting rod and a lower connecting rod arranged up and down, wherein the connecting mechanism comprises a base, and a transmission mechanism which is arranged in an inner cavity of the base, wherein one end of the upper connecting rod extends into an upper inner cavity of the base and is rotationally connected with the base by an upper shaft pin, the other end of the upper connecting rod is rotationally connected with the frame body in the folding driving device by an upper rotating shaft pin, and one end of the lower connecting rod extends into a lower inner cavity of the base and is rotationally connected with the base by a lower shaft pin, and the end of the lower connecting rod that extends into the lower inner cavity of the base is linked with the transmission mechanism, the lower shaft pin is located below the upper shaft pin and rotationally connected with the base, and the other end of the lower connecting rod is rotationally connected with the frame body by the lower rotating shaft pin.

As improvement, the transmission mechanism is a swing block, and the swing block is swingingly arranged in the lower inner cavity of the base through a swing shaft; the lower shaft pin is arranged in the inner cavity of the base at an upper right position of the swing block; the swing block is provided thereon with a transmission roller which can abut with an end of the lower connecting rod so as to push the swing block to swing to the left and a connecting shaft that can be connected with a pull rope; the swing shaft is arranged on a lower position of the swing block at a lower left position of the lower shaft pin; and the connecting shaft connected with the pull rope is fixed on a left side of the swing shaft.

As improvement, the transmission mechanism comprises a first swing connecting rod and a second swing connecting rod; one ends of the first swing connecting rod and the second swing connecting rod are folded in a Chinese character "人" shape and connected together in a manner that they can be rotated relatively to each other through a movable pin; and the other end of the first swing connecting rod is rotationally connected to an end of the lower connecting rod through a rotation pin, and the other end of the second swing connecting rod is movably connected with the base through a positioning pin shaft; and the pull rope extending into in the base is connected with the movable pin.

As improvement, the transmission mechanism is a swing block; a lower part of the swing block is swingingly arranged in a lower inner cavity of the base through a swing shaft; the lower shaft pin is arranged on the inner cavity of the base at a upper right position of the swing shaft; the swing block is provided thereon with a roller body that can abut with an arc-shaped end of a lower connecting rod so as to push the swing block to swing left and right; the pull rope is connected with the roller body located at a side position of the end of the lower connecting rod; a support wheel for the pull rope is provided in the inner cavity of the base on a right side of the swing shaft and below the lower shaft pin; and the pull rope connected with the roller body bypasses the support wheel, and then bypasses the swing shaft to extend upward into an inner cavity of the bed legs.

As improvement, the folding driving device comprises a frame body that can move up and down relative to the bed legs, a guide rod which is vertically fixed on a middle part of the frame body and extends out downwards from a middle part of a bottom surface of the frame body, and a sliding seat that can move up and down along the guide rod, wherein the other ends of the upper connecting rod and the lower connecting rod, which are movably connected to each bed leg, are respectively rotationally connected with the frame body at corresponding positions, through the upper rotating shaft pin and the lower rotating shaft pin; and the sliding seat is movably connected with a corresponding lower connecting rod through a transmission rod.

As further improvement, a lower end of the transmission rod is rotationally connected with a corresponding side surface of the sliding seat through a lower transmission shaft pin, and an upper end of the transmission rod is rotationally connected with the lower connecting rod through the upper transmission shaft pin.

As further improvement, the frame body is further provided with a locking mechanism that can maintain an opening state when the bed body is completely opened; the locking mechanism comprises an unlocking drawbar and a locking sheet; the unlocking drawbar is placed in an inner cavity of the guide rod in a manner of being able to move up and down; a vertical through hole penetrating up and down is provide at a center of the frame body; the guide rod is inserted and fixed in the vertical through hole of the frame body; a top surface of the guide rod is flush with a top surface of the frame body and a lower end of the guide rod extends out downward from a bottom surface of the frame body; an unlocking structure of the unlocking drawbar is provided on a top surface of the frame body; the locking sheet is located in the inner cavity of the unlocking drawbar; when the folding driving device moves down to a lowest position to completely unfold the bed body, the locking sheet can extend out, after passing through corresponding side surfaces of the unlocking drawbar and the guide rod such that the locking sheet and a bottom surface of the sliding seat are supported by each other and locked; when the bed body needs to be folded and unlocking is to be performed, the unlocking structure drives the locking sheet to retract into the inner cavity of the unlocking drawbar to be disengaged from the sliding seat, enabling the sliding seat to move down to performing the unlocking.

As further improvement, the locking sheet is located in a lower inner cavity of the unlocking drawbar; the locking sheet is composed of at least two positioning sheets; a lower part of each positioning sheet is provided with a connecting hole for allowing a horizontal shaft pin to be inserted; the positioning sheet above the connecting hole is provided with an oblique strip hole; the positioning sheets are folded together like a folding fan; lower parts of the positioning sheets are connected together by the horizontal shaft pin being inserted through the connecting hole such that the positioning sheets can be unfolded and folded left and right like a folding fan; left and right ends of the horizontal shaft pin are respectively fixed on corresponding left and right side surfaces of a lower part of the guide rod; a folding pull shaft is inserted and arranged in the oblique strip hole, with the folding pull shaft capable of moving up and down in the oblique strip hole to unfold and fold the positioning sheets; left and right ends of the folding pull shaft are radially fixed on corresponding left and right side surfaces of the unlocking drawbar; the unlocking drawbar is provided with a notch allowing the positioning sheets to extend out from a side surface of the unlocking drawbar when being unfolded left and right; through cavities are respectively provided on left and right side surfaces of the guide rod at a position corresponding to the notch, with the through cavities allowing the positioning sheets to extend out from the side surface of the guide rod after passing through the notch when the positioning sheets are unfolded; a top surface of the positioning sheets extending out from the through cavity and a bottom surface of the sliding seat can be supported by each other; vertical waist-shaped holes are respectively formed on left and right side surfaces of the unlocking drawbar in an upper part of the inner cavity at a middle part of the unlocking drawbar; a fixing shaft pin is radially inserted and arranged in the waist-shaped holes; a left end of the fixing shaft pin passes through the left side surface of the unlocking drawbar to be fixed together with a corresponding left side surface of the guide rod; a right end of the fixing shaft pin passes through a right side surface of the unlocking drawbar to be fixed together with a corresponding right side surface of the guide rod; a return spring is provided in the inner cavity of the unlocking drawbar located above the notch; a bottom of the return spring and a support part in the inner cavity of the unlocking drawbar above the notch are supported by each other, an upper end of the return spring and the fixing shaft pin can abut with and be supported by each other; and the waist-shaped hole has a upper-lower hole distance which needs to be greater than a maximum distance after the folding pull shaft moves up and down to make the positioning sheets completely folded.

As further improvement, a top of the frame body is connected with a pull part that can pull the frame body upward; the unlocking structure is a pressing protruding end of the unlocking drawbar extending out from the vertical through hole or a pressing flushing end where the top surface of the unlocking drawbar is flush with a top surface of the vertical through hole; the locking sheet is located in the inner cavity of the middle part of the unlocking drawbar; the locking sheet is composed of at least two positioning sheets; a upper part of each positioning sheet is provided with a connecting hole for allowing the horizontal shaft pin to be inserted; the positioning sheet below the connecting hole is provided with an oblique strip hole; the positioning sheets are folded together like a folding fan; upper parts of the positioning sheets are connected together through the horizontal shaft pin being inserted in the connecting hole, so that the positioning sheets can be unfolded and folded left and right like a folding fan; left and right ends of the horizontal shaft pin are respectively fixed on corresponding left and right side surfaces of the upper part of the guide rod; a folding pull shaft is inserted and arranged in the oblique strip hole, with the folding pull shaft being movable up and down in the oblique strip hole to unfold and fold the positioning sheets; left and right ends of the folding pull shaft are radially fixed on corresponding left and right side surfaces of the unlocking drawbar; the unlocking drawbar is provided with a notch allowing the positioning sheets to extend out from a side surface of the unlocking drawbar when being unfolded left and right; through cavities are respectively provided on left and right side surfaces of the guide rod at position corresponding to the notch, with the through cavities allowing the positioning sheets to extend out from the side surface of the guide rod after passing through the notch when the positioning sheets are unfolded; a snapping surface of the positioning sheets extending out from the through cavities can snapped with a bottom surface of the sliding seat; left and right side surfaces of the unlocking drawbar located in the upper part of the inner cavity at the middle part of the unlocking drawbar are respectively provided with vertical waist-shaped holes; the horizontal shaft pin is radially inserted and arranged in the waist-shaped hole; a return spring is arranged in the inner cavity of the guide rod below the through cavities; an upper end of the return spring abuts with the unlocking drawbar; a lower end of the return spring and a support rod located in the inner cavity of the guide rod are supported by each other; a upper-lower hole distance of the waist-shaped hole needs to be greater than a maximum distance after the folding pull shaft moves up and down to make the positioning sheets completely folded; a top of the unlocking drawbar is pressed to drive the locking sheets to retract into the inner cavity of the unlocking drawbar so as to be disengaged from the sliding seat; and the pull part is pulled upward to make the sliding seat move downward to perform unlocking.

As improvement, the guard bar comprises a left bar body and a right bar body which can be movably connected with tops of the corresponding bed legs and a folding part located between the left bar body and the right bar body and capable of folding the left bar body and the right bar body; the folding part comprises a shell body, an elastic positioning body located in a middle part of an inner cavity of the shell body, and a left turning part on a left side of the elastic positioning body and a right turning part on a right side of the elastic positioning body; a right part of the left bar body extends into a left inner cavity of the shell body to be rotationally connected with the shell body; a right end of the left bar body is in transmission connection with the left turning part; the left turning part is connected with a pull rope extending upward from the base of the left bed leg; a left part of the right bar body extends into a right inner cavity of the shell body to be rotationally connected with the shell body; a left end of the right bar body is in transmission connection with a right turning part; and the right turning part is connected with the pull rope extending upward from the base of the right bed leg.

As further improvement, each turning part comprises a turning block and a positioning block; a middle part of the turning block is, through a turning block shaft pin, rotationally connected in the inner cavity of the corresponding shell body; one end of the turning block is movably connected with one end of the positioning block; the other end of the positioning block is rotationally connected with an end of a corresponding left bar body or right bar body; and the positioning block is provided thereon with a positioning protrusion capable of abutting with the elastic positioning body.

As further improvement, the positioning block is composed of two positioning sheet bodies in a same shape; the two positioning sheet bodies are symmetrically arranged; one end of a corresponding turning block is clamped between one ends of the two positioning sheet bodies and the one ends of the two positioning sheet bodies can be relatively movably connected together by a rotating shaft; an end of a corresponding left bar body or right bar body is clamped between the other ends of the two positioning sheet bodies and the other ends of the two positioning sheet bodies are mutually rotationally connected together through a sheet body shaft pin; and one end of a corresponding pull rope bypasses an arc-shaped side wall of a corresponding turning block to be connected with the rotating shaft.

As further improvement, the elastic positioning body comprises a compression spring and a compression rod that can abut with the positioning protrusion; the elastic positioning body is provided with two spring cavities for accommodating corresponding compression springs; one ends of the compression springs placed in the spring cavities respectively abut with bottom surfaces of corresponding spring cavities; the other ends of the compression springs respectively abut with a corresponding compression rod; a position-limiting waist-shaped through hole is respectively provided on a side wall of the shell body at a position corresponding to the compression springs; the compression rod is inserted and arranged in a corresponding position-limiting waist-shaped through hole; when the guard rod is unfolded, the compression rod and the positioning protrusion on the positioning block can be supported by each other and at this time, a corresponding group of sheet body shaft pin, the rotating shaft, and a turning block shaft pin are located on one straight line from top to bottom, as a line connecting three points; and when the guard rod is folded, the compression rod pushes the positioning protrusion to unlock the rotating shaft, and the positioning block rotates to separate the compression rod from the positioning protrusion.

As further improvement, a left pull rope spring is connected to the pull rope below the left bar body; one end of the left pull rope spring is connected with an outer end of the pull rope on the left turning block, and the other end of the left pull rope spring is connected together with a transmission mechanism in a corresponding base through the pull rope extending downward to pass through the inner cavity of the left bed leg; a right pull rope spring is connected to the pull rope below the right bar body; and one end of the right pull rope spring is connected with an outer end of the pull rope on the right turning block; the other end of the right pull rope spring is connected together with the transmission mechanism in a corresponding base through the pull rope extending downwards to pass through the inner cavity of the right bed leg; and a lowest end of the pull rope connected with the folding part is lower than a position of an extending-in point where the pull rope extends into the inner cavity of a corresponding bed leg.

Compared with the prior art, the present application has the advantages as follows. A four-bar linkage mechanism is formed by defining the connection points at both ends of the upper connecting rod and the lower connecting rod, and the four-bar linkage mechanism has the function of driving the bed legs to tilt. The folding driving device is pressed downward to make the bed body unfold. In the initial stage of the bed body being unfolded, the unfolding amplitude of the upper ends of the bed legs is greater than the unfolding amplitude of the lower ends of the bed legs. The bed legs are inclined to the outside, so that the upper fence of the bed body is first unfolded. The folding driving device is continuously pressed down. The lower connecting rod drives the transmission mechanism to be in turn linked with the pull rope to realize the locking of the guard bar. During this process, the lower end of the bed leg continues to unfold to the normal state of use. The folding driving device is lifted up. The lower connecting rod loses its driving force to the transmission mechanism. The elastic positioning body pushes the corresponding turning part to rotate, so that the folding part is unlocked. The folding driving device is continuously lifted to make the bed body completely folded. The present application realizes one-key opening and one-key folding of the bed body through a simple four-bar linkage mechanism and a transmission mechanism. And the mechanism has simple components, and is reliable and easy to manufacture. When the bed body is fully unfolded, the transmission roller of the transmission mechanism abuts with the lower arc surface of the arc-shaped end of the lower connecting rod. The transmission roller locks the lower connecting rod to avoid arching of the frame body and make the entire bottom frame flat.

DETAILED DESCRIPTION OF EMBODIMENTS

Figure 1:
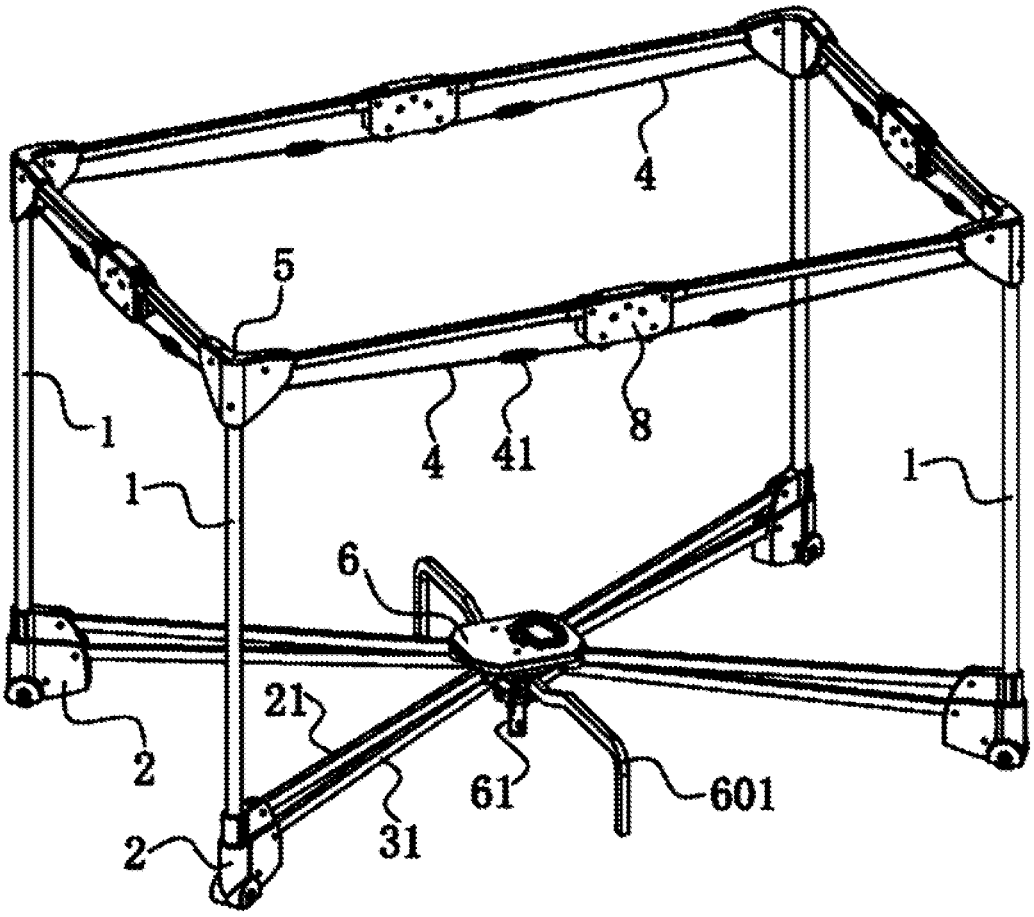
FIG. 1 is a perspective view of an embodiment of the present application applied to a child game bed.
Figure 2:
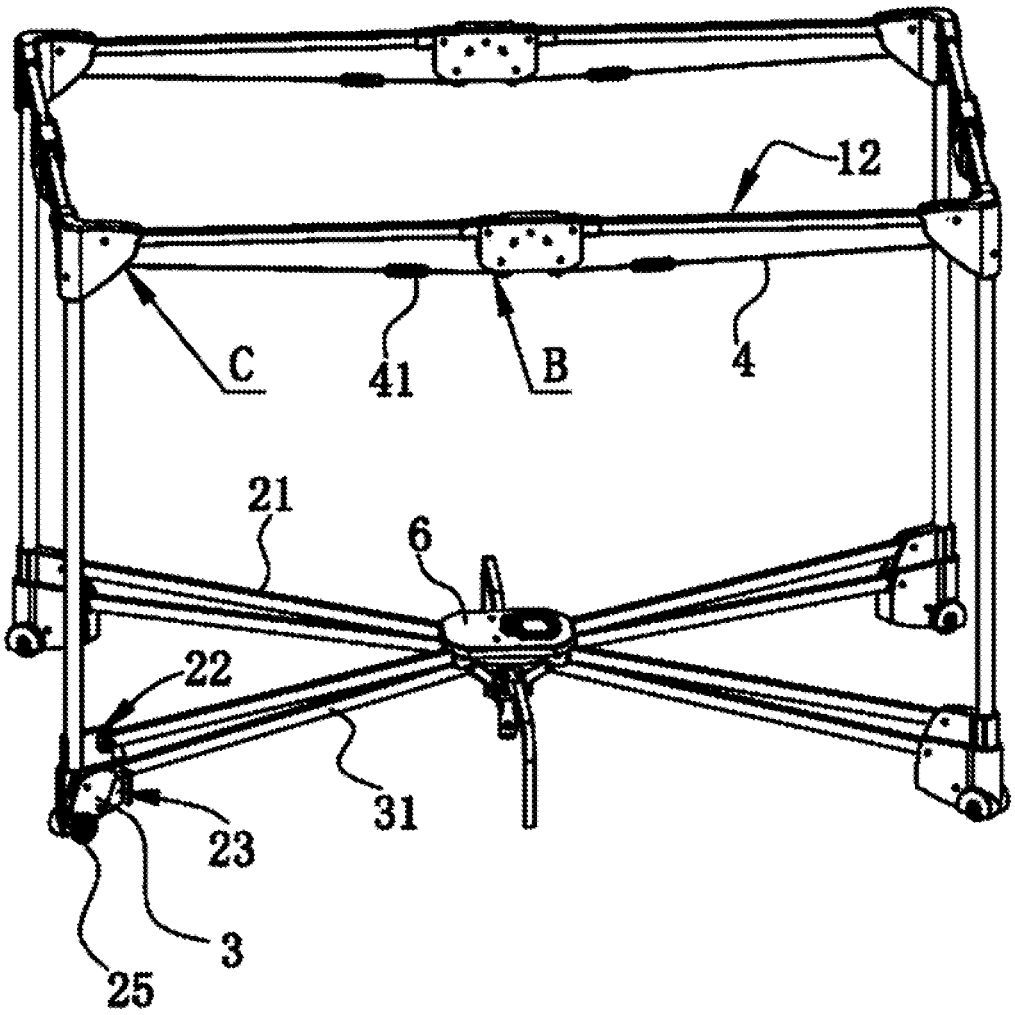
FIG. 2 is a perspective view of FIG. 1 with a half of the shell of the base removed.
Figure 3:
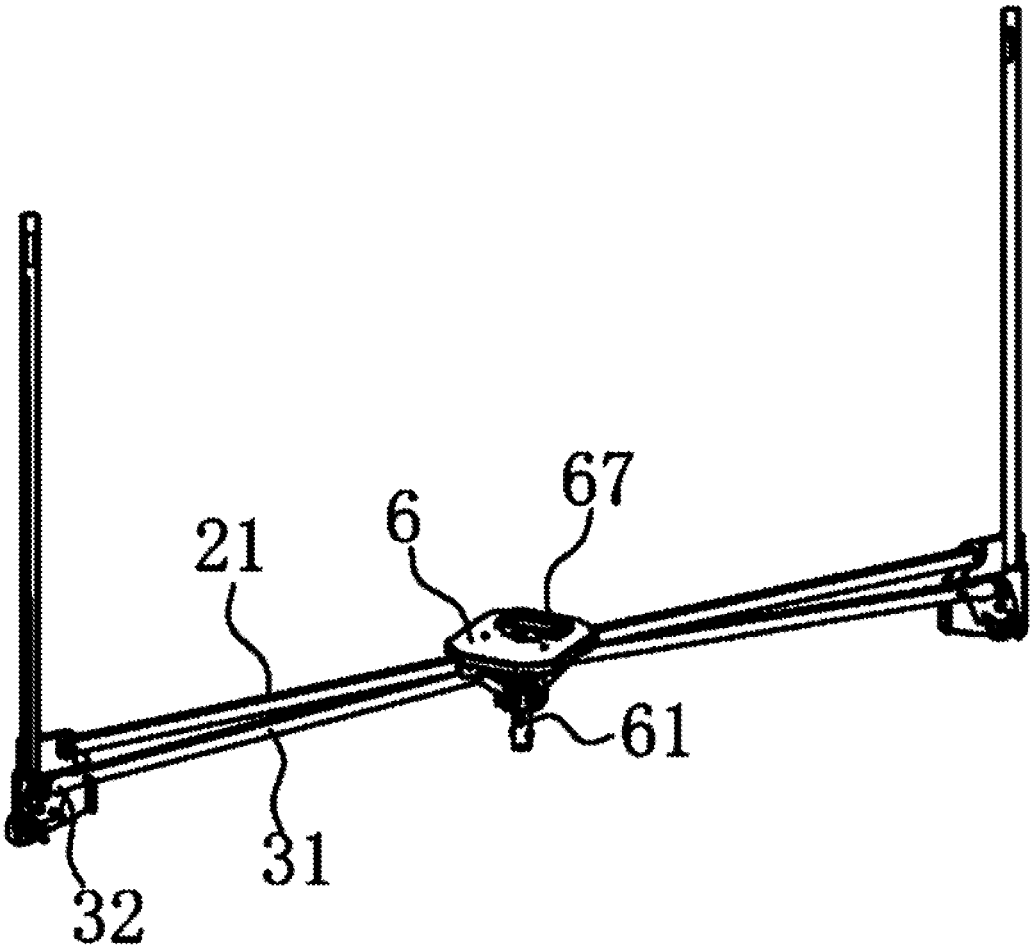
FIG. 3 is a schematic structural view showing that the connecting rods in FIG. 2 are connected with the corresponding bed legs, the base (partial), and the folding driving device.
Figure 4:
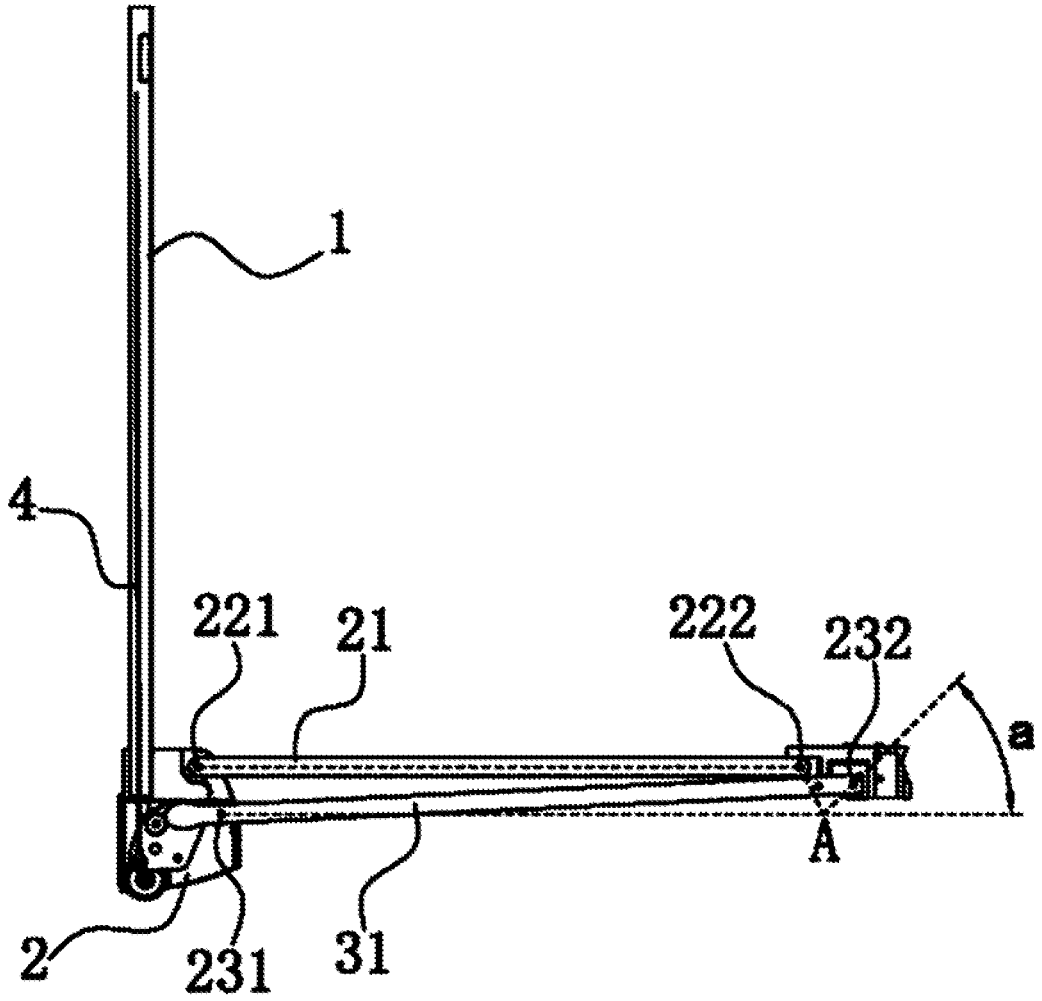
FIG. 4 is a front projection view showing that one group of connecting rods in FIG. 3 remains and the side of the group of connecting rods is set as the front side.

The present application will be further described in detail below in conjunction with the embodiments of the drawings.

As shown in FIGS. 1 to 29, the portable child game bed of this embodiment comprises four bed legs 1 and a folding driving device placed in the middle part of the bed bottom capable of folding and unfolding the bed body. A guard rod 12 foldable in the middle is provided between two adjacent bed legs 1 and at the top thereof. Both ends of the guard rod 12 are respectively movably connected with the tops of the corresponding bed legs 1. A connecting mechanism movably connected with the folding driving device through a connecting rod is provided at the bottom of each bed leg 1. The connecting rod is composed of an upper connecting rod 21 and a lower connecting rod 31 arranged up and down. The connecting mechanism comprises a base 2 and a transmission mechanism arranged in the inner cavity of the base 2. One end of the upper connecting rod 21 extends into the upper inner cavity 22 of the base 2 and is rotationally connected with the base 2 via an upper shaft pin 221. The other end of the upper connecting rod 21 is rotationally connected with the frame body 6 in the folding driving device through an upper rotating shaft pin 222. One end of the lower connecting rod 31 extends into the lower inner cavity 23 of the base 2 and is rotationally connected with the base 2 through a lower shaft pin 231. And the end of the lower connecting rod that extends into the lower inner cavity 23 of the base 2 is linked with the transmission mechanism. The lower shaft pin 231 is located below the upper shaft pin 221 and is rotationally connected with the base 2. The other end of the lower connecting rod 31 is rotationally connected with the frame body 6 through a lower rotating shaft pin 232.

The first type of transmission mechanism is the swing block 3. The swing block 3 is swingingly disposed in the lower inner cavity 23 of the base 2 through a swing shaft 37. The lower shaft pin 231 is arranged in the inner cavity of the base at the upper right position of the swing block 3. A transmission roller 34 and a connecting shaft 36 are provided on the swing block 3, wherein the transmission roller 34 can abut with the end of the lower connecting rod so as to push the swing block 3 to swing to the left, and the connecting shaft 36 can be connected with the pull rope 4. The swing shaft 37 is provided at a lower position of the swing block 3 at the lower left of the lower shaft pin 231. The connecting shaft 36 connected to the pull rope 4 is fixed on the left side of the swing shaft 37. The swing block 3 is composed of two swing sheets, and the two swing sheets are fixed together by a swing sheet connecting column 35.

Figure 10:
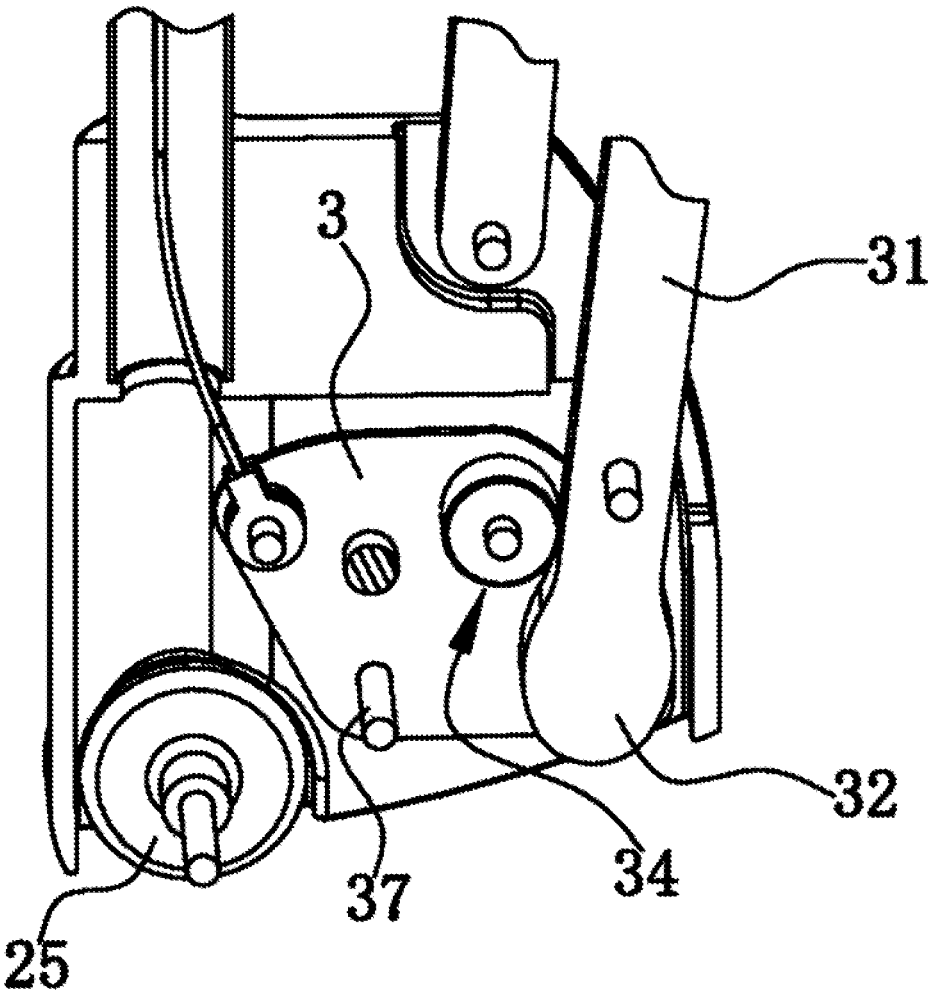
FIG. 10 is a schematic structural view showing the positional relationship between the transmission roller and the arc-shaped end in FIG. 8.
Figure 11:
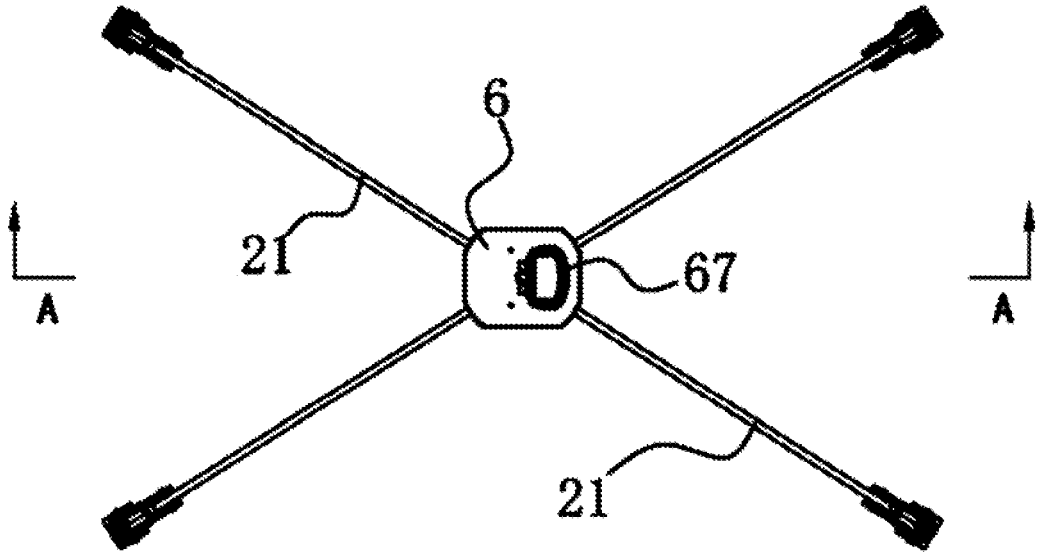
FIG. 11 is a top view of FIG. 1 with the bed legs and the connecting structure at the upper part of the bed legs removed.
Figure 12:
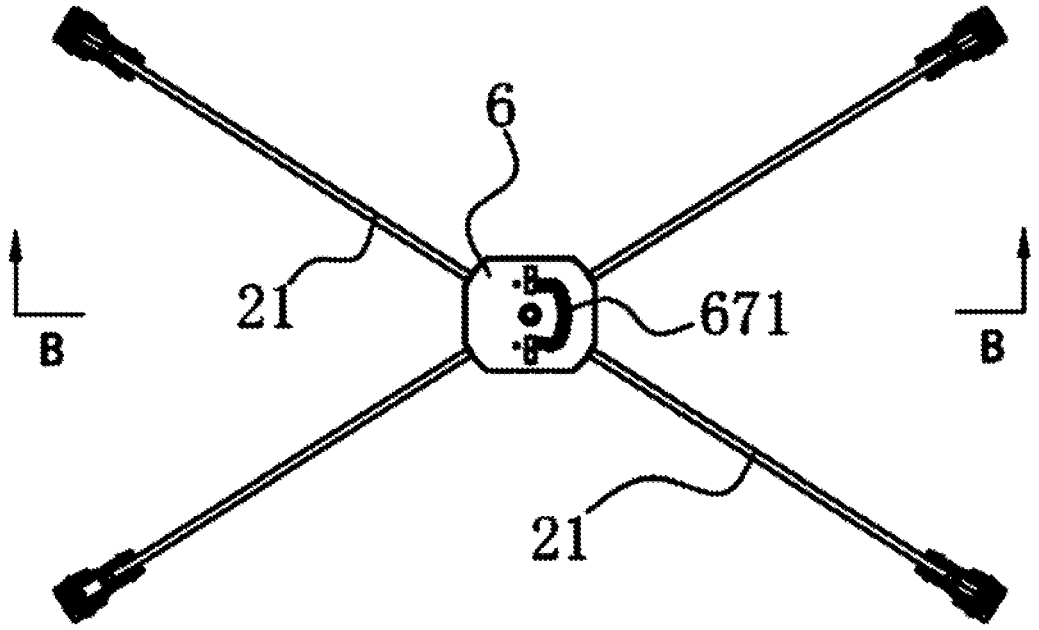
FIG. 12 is a top view of FIG. 11 when the second type of locking mechanism is used.
Figure 13:
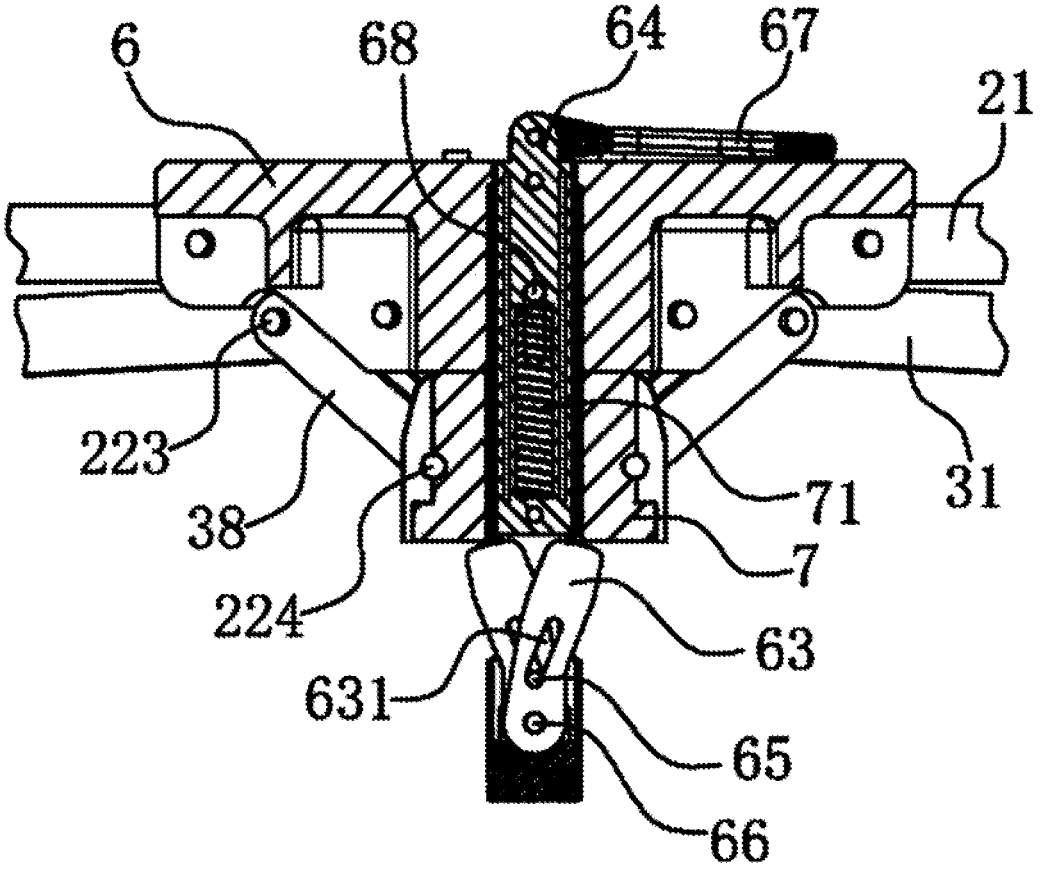
FIG. 13 is a sectional view along the line A-A in FIG. 11.
Figure 14:
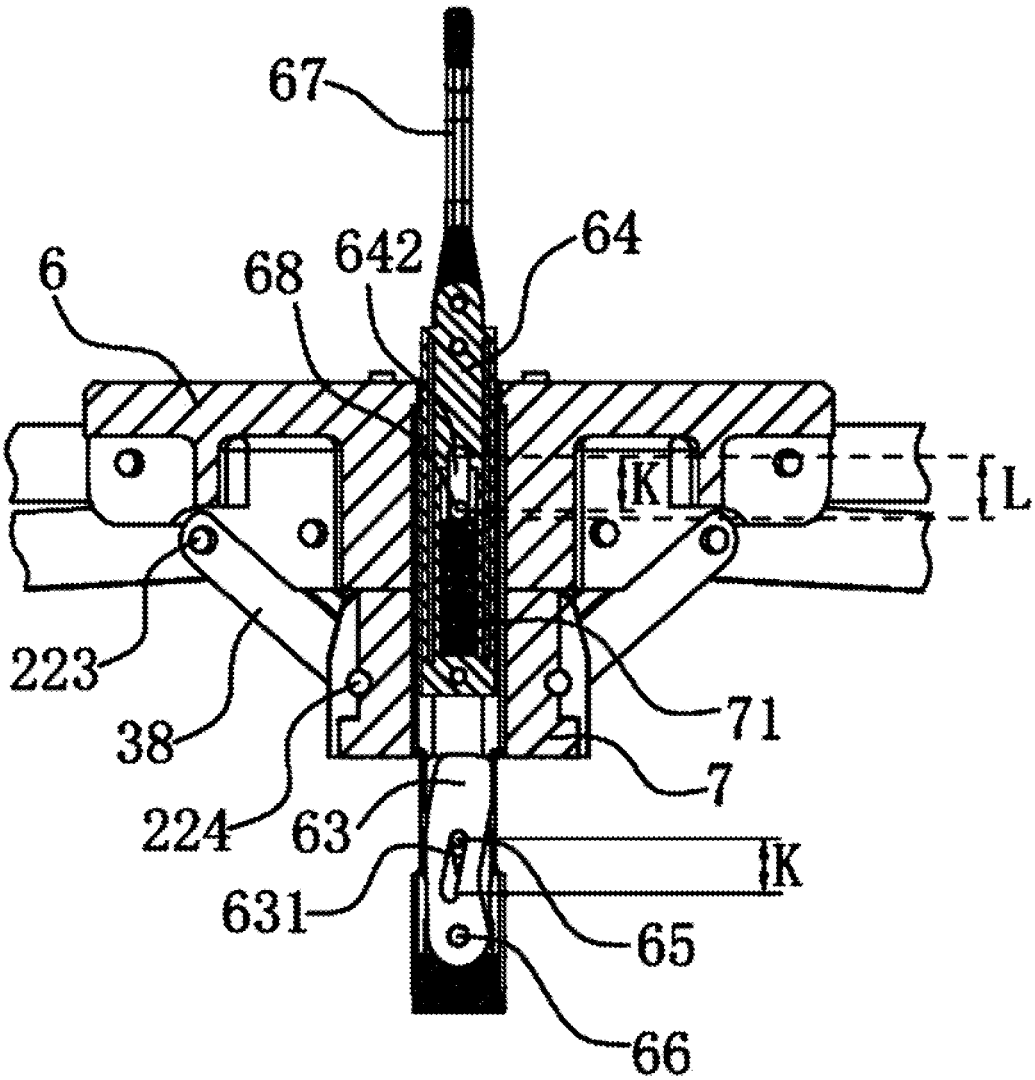
FIG. 14 is a sectional view of FIG. 13 after the pull part is pulled up to be unlocked.
Figure 15:
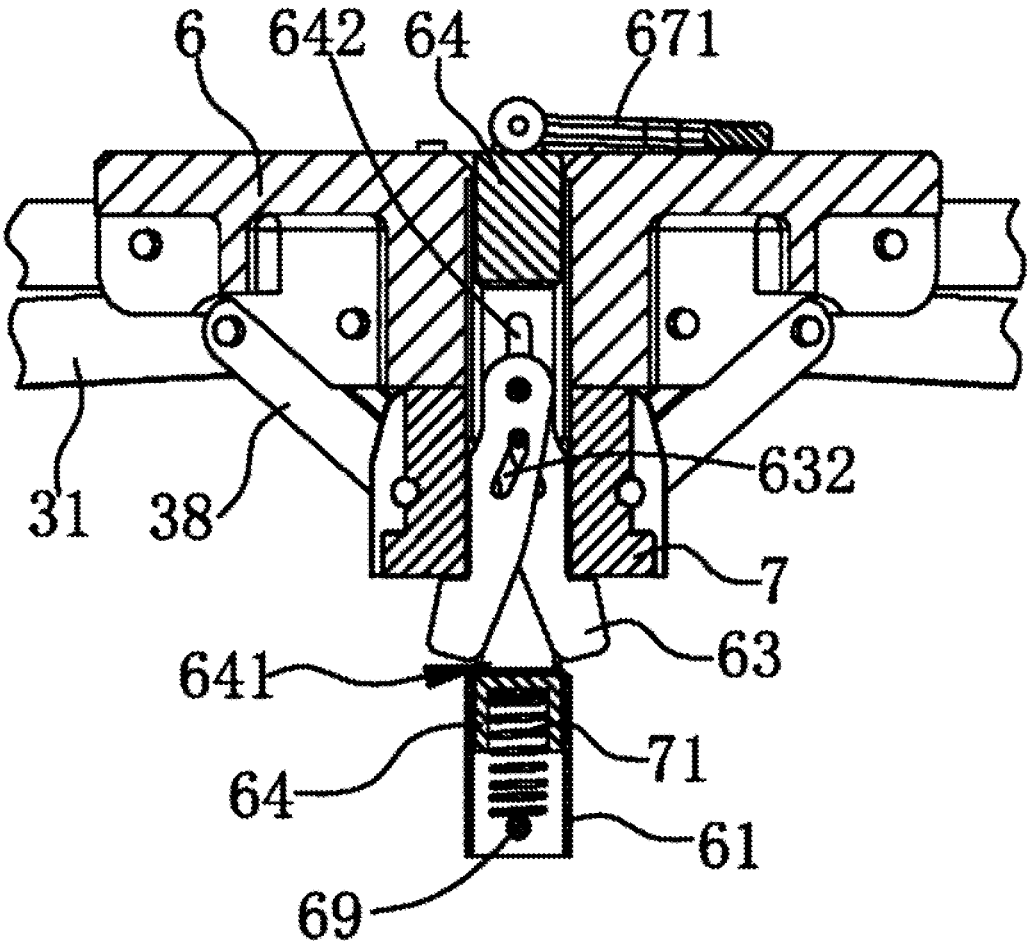
FIG. 15 is a sectional view along the line B-B in FIG. 12.
Figure 16:
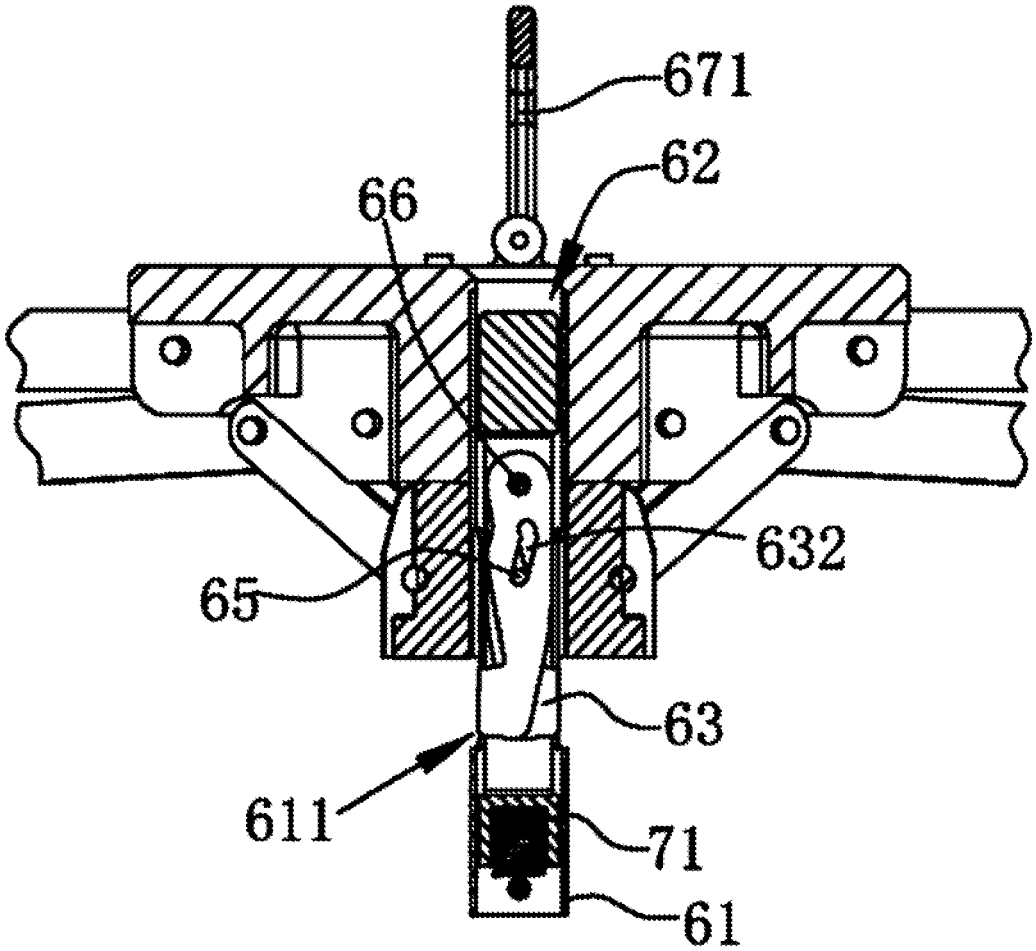
FIG. 16 is a sectional view of FIG. 15 when the pull part is pulled after the unlocking drawbar is pressed.

When the bed body is folded, the transmission roller 34 is located on the right side of the swing shaft 37, as shown in FIG. 10. The transmission roller 34 and the connecting shaft 36 are respectively located in the cavity of the swing block 3. The end of the lower connecting rod located in the inner cavity of the base extends into the cavity of the swing block 3. The end of the lower connecting rod extending into the cavity of the swing block 3 is an arc-shaped end 32. When the child game bed is fully unfolded so as to make the other end of the lower connecting rod 31 move down to the lowest end, the bottom end of the arc-shaped end 32 of the lower connecting rod 31 and the transmission roller 34 are supported by each other. When the child game bed is gradually retracted and folded, the end surface of the arc-shaped end 32 of the lower connecting rod 31 bypasses the transmission roller 34 and moves away from the axis of the transmission roller. When the frame body 6 moves up to the highest end, one side of the arc-shaped end 32 and the transmission roller 34 are supported by each other. The transmission roller 34 is composed of a positioning shaft pin 33 inserted and connected to two swing sheets, and a transmission wheel 341 rotationally sleeved on the positioning shaft pin 33 in the inner cavity of the swing block. The side wall of the transmission wheel 341 can abut with the arc-shaped end 32. The two ends of the connecting shaft 36 are respectively inserted and fixed on two swing sheets arranged in parallel on the left and right. The pull rope 4 is connected with a loop (lantern ring). The loop is sleeved on the connecting shaft 36. When the child game bed is fully unfolded, the transmission roller 34 abuts on the lower arc surface of the arc-shaped end of the lower connecting rod. The transmission roller 34 fulfills a locking effect on the lower connecting rod 31 to avoid arching of the frame body and make the entire bottom frame flat. The arc-shaped end of the lower connecting rod is elliptical. When the child game bed is fully unfolded, the transmission roller passes through the curved surface of the elliptical arc-shaped end to abut with the lower arc surface of the elliptical arc-shaped end.

Figure 17:
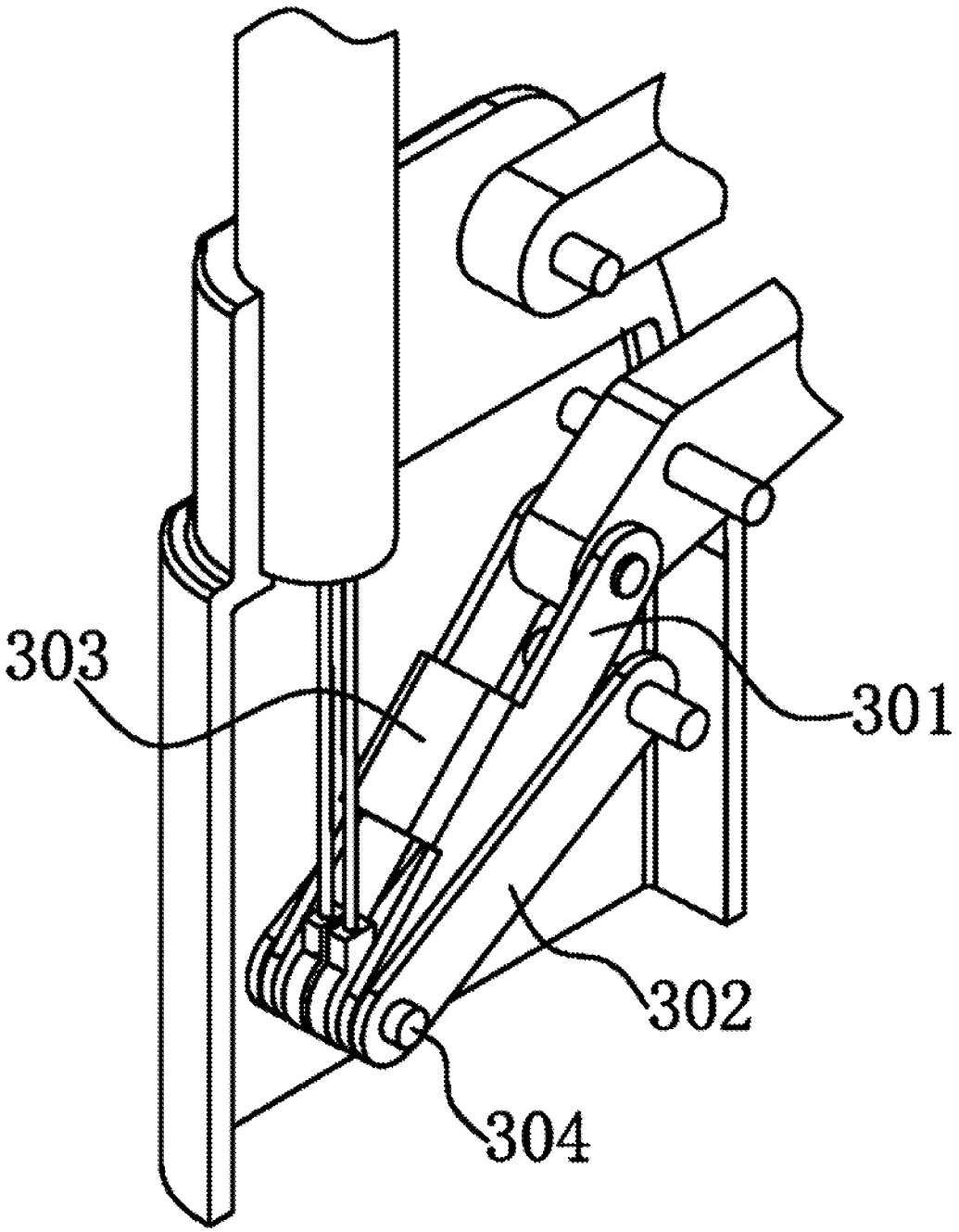
FIG. 17 is a schematic structural view of FIG. 6 with the second type of transmission mechanism used.

As shown in FIG. 17, the second type of transmission mechanism comprises a first swing connecting rod 301 and a second swing connecting rod 302. One ends of the first swing connecting rod 301 and the second swing connecting rod 302 are folded in a Chinese character "A" shape, and are relatively rotationally connected together by a movable pin 304. The other end of the first swing connecting rod 301 is rotationally connected with the end of the lower connecting rod 31 through a rotating pin. The other end of the second swing connecting rod 302 is movably connected with the base 2 through a positioning pin shaft. The pull rope 4 extending into the base 2 is connected with the movable pin 304. The first swing connecting rod 301 is composed of a front rod sheet and a rear rod sheet. The front rod sheet is fixed on one side surface of the support frame 303, and the rear rod sheet is fixed on the other side surface of the support frame 303. The second swing connecting rod 302 is composed of a front bar body and a rear bar body. The rear side wall of the front bar body is attached to the front side wall of the front rod sheet, and the front side wall of the rear bar body is attached to the rear side wall of the rear rod sheet. The movable pin 304 strings together one ends of the front rod sheet, the rear rod sheet, the front bar body and the rear bar body, which are movably connected together. The other ends of the front rod sheet and the rear rod sheet are arranged as stringed in series with the arc-shaped end 32 of the lower connecting rod 31 through a rotating pin, and thus are movably connected together. The other ends of the front bar body and the rear bar body are arranged as stringed in series through a positioning pin shaft, and thus are movably connected to the base 2 together. When the child foldable bed is fully unfolded, the rotating pin is located above the connection line between the movable pin 304 and the lower shaft pin 231, thereby locking the child foldable bed. During the unfolding process, the end of the lower connecting rod 31 is lifted upward, the first swing connecting rod 301 and the second swing connecting rod 302 are driven to rotate. The movable pin 304 moves downward to pull the pull rope 4 downward tightly. On the contrary, the pull rope 4 is released. When the child foldable bed is fully unfolded, the rotating pin is located above the connection line between the movable pin 304 and the lower shaft pin 231, which locks the lower connecting rod 31, prevents the frame body from arching, and makes the entire bottom frame flat.

Figure 18:
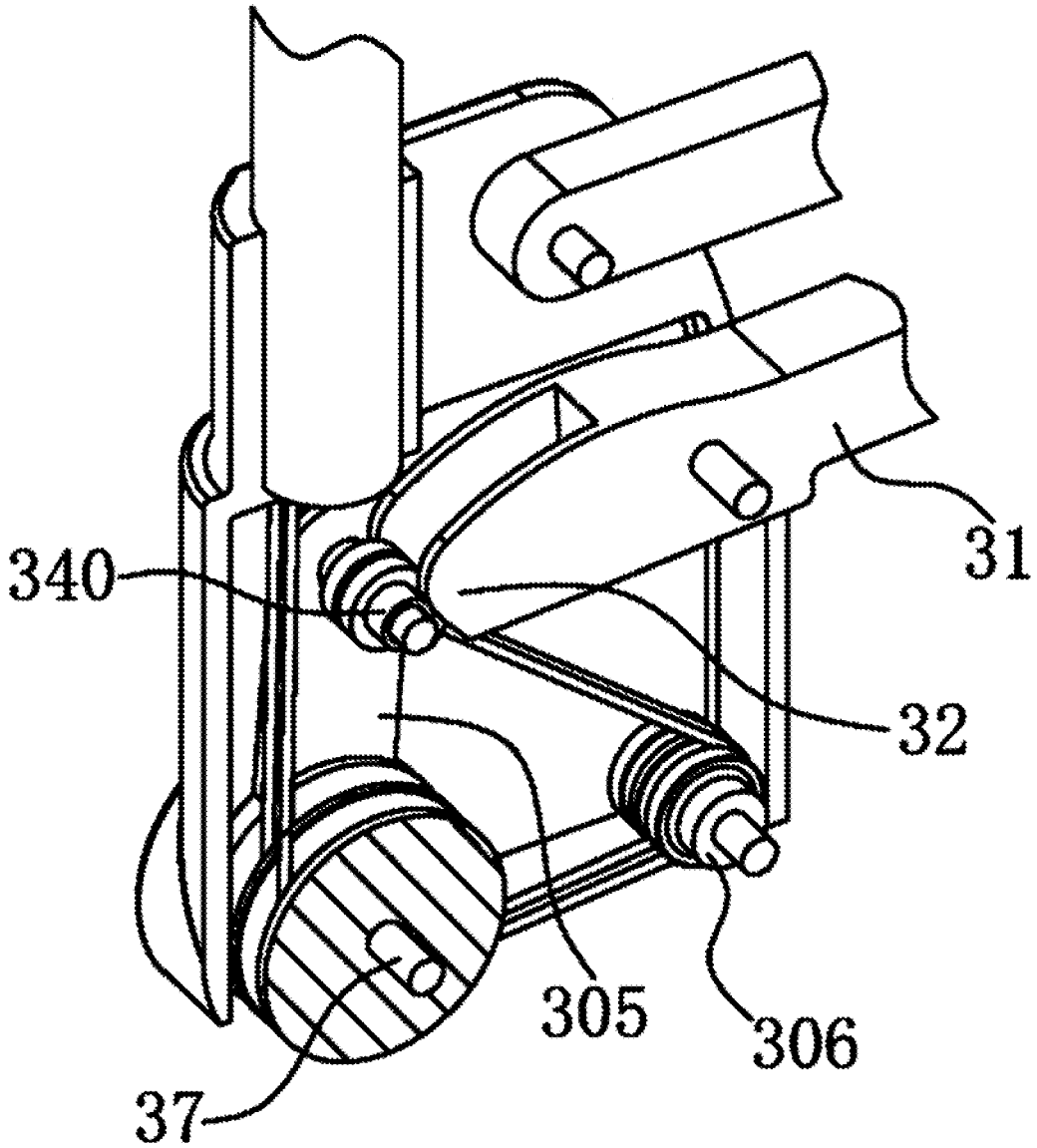
FIG. 18 is a schematic structural view of FIG. 6 with the third type of transmission mechanism used.
Figure 19:
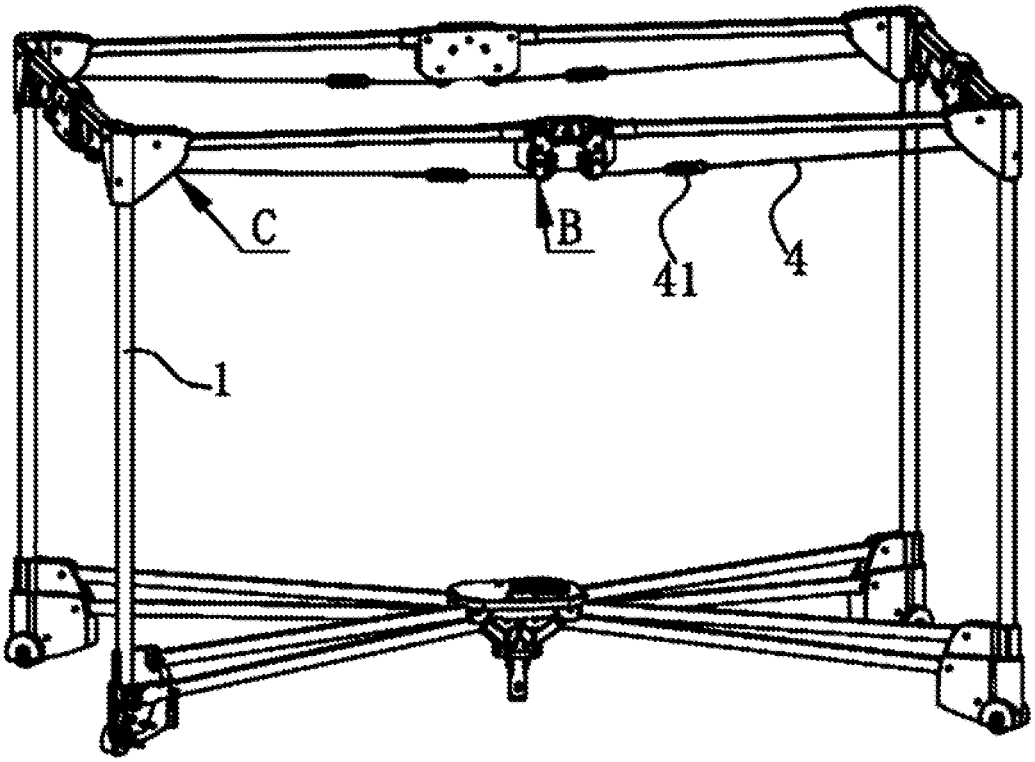
FIG. 19 is a perspective view of FIG. 2 with the half of the shell at the middle part of the guard bar removed.
Figure 20:
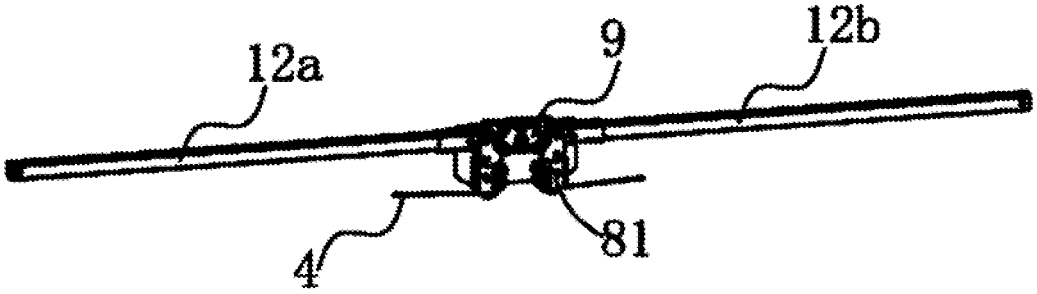
FIG. 20 is a perspective view of FIG. 19 showing the specific structure of the guard bar, when the guard bar taken out separately.
Figure 21:
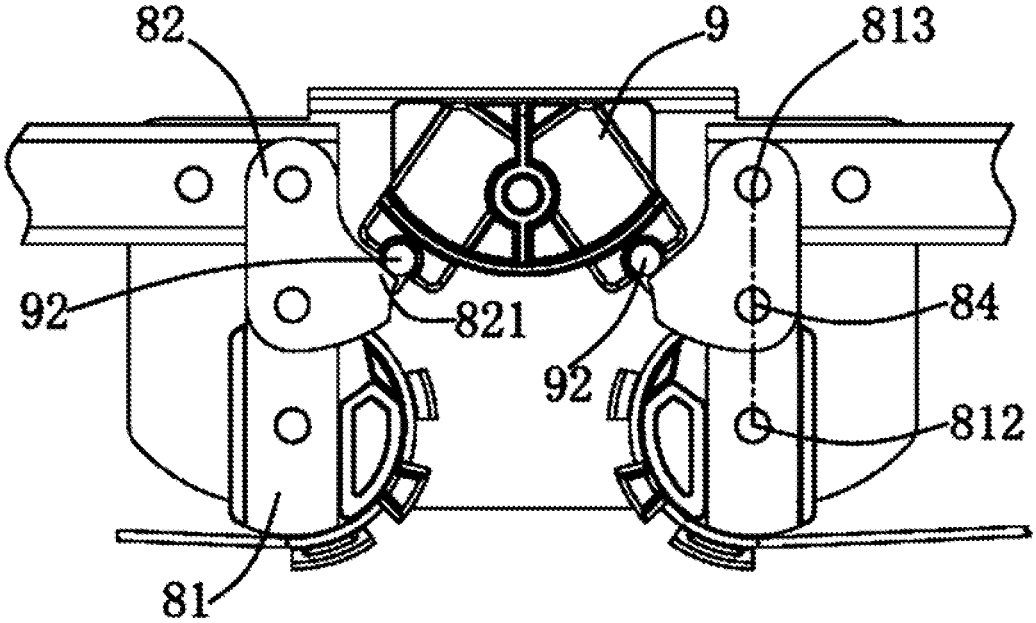
FIG. 21 is a front projection view of FIG. 20.
Figure 22:
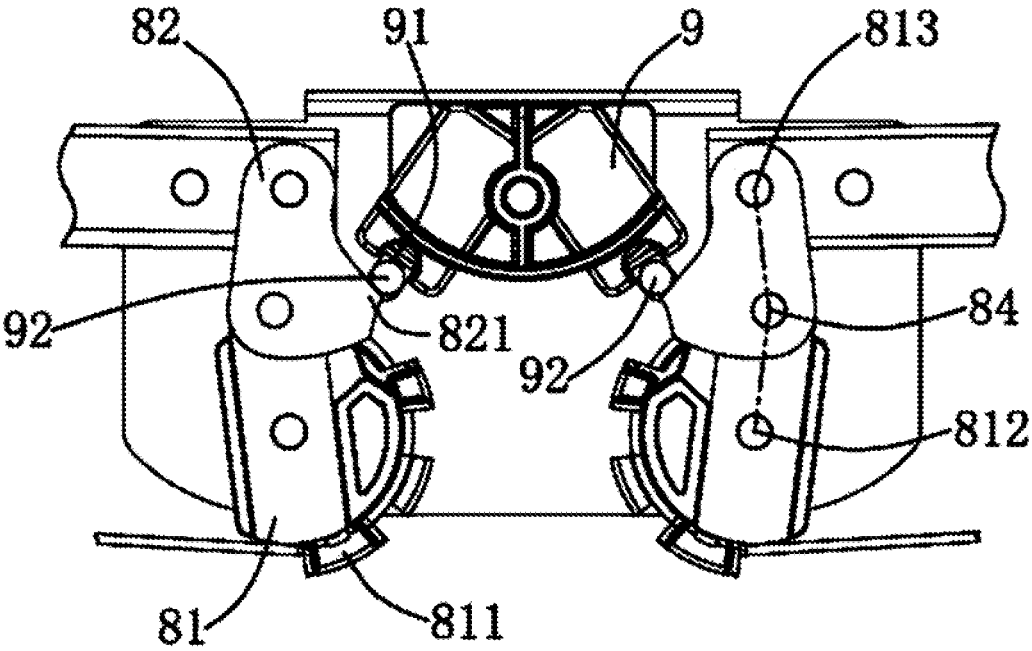
FIG. 22 is a schematic structural view of FIG. 21, showing that the elastic positioning body unlocks the turning part when the transmission mechanism releases the pull rope.
Figure 23:
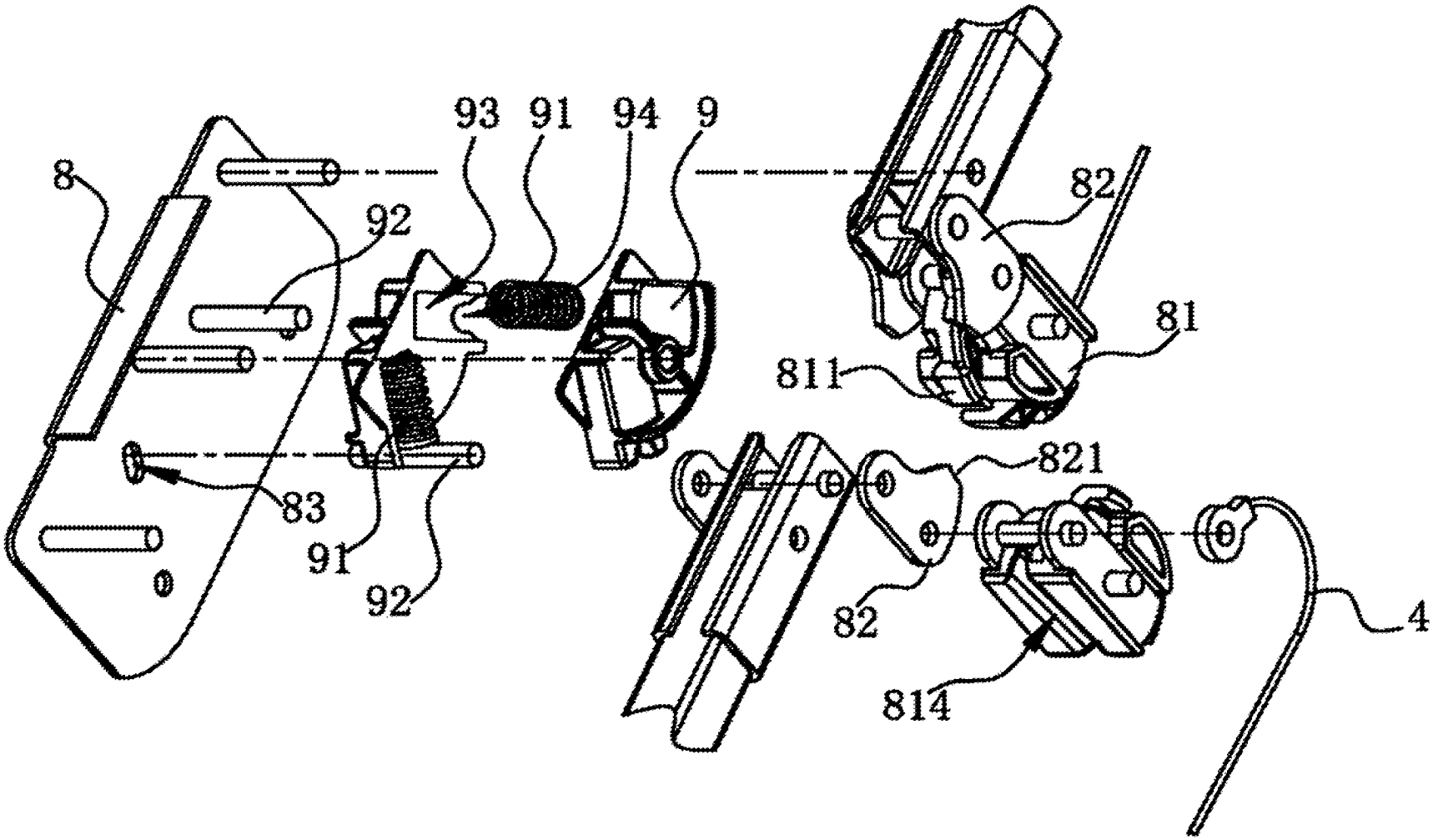
FIG. 23 is an exploded structural view of FIG. 20.
Figure 24:
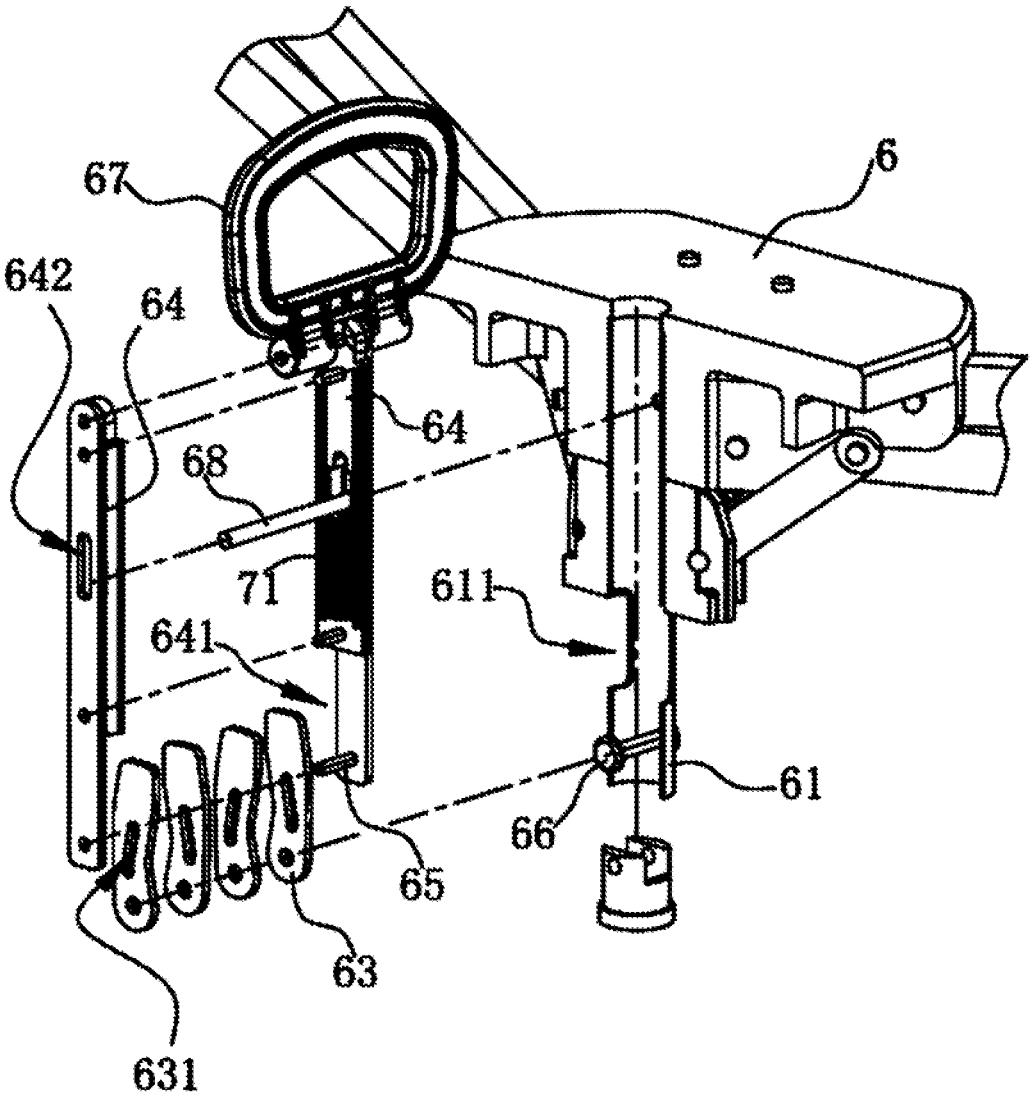
FIG. 24 is an exploded structural view of FIG. 14.
Figure 25:
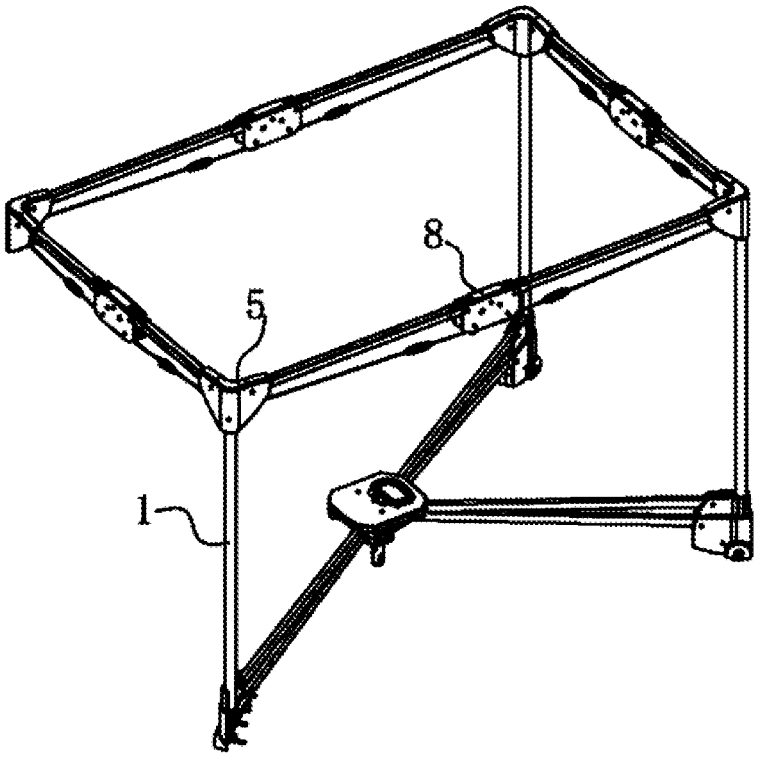
FIG. 25 is a perspective view of FIG. 1 with one bed leg removed.
Figure 26:
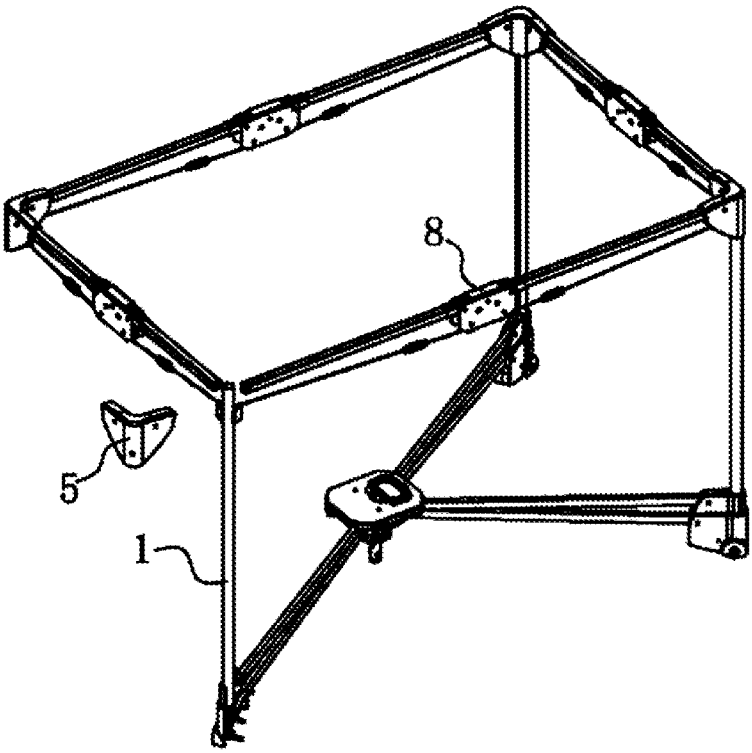
FIG. 26 is an exploded structural view of FIG. 25.
Figure 27:
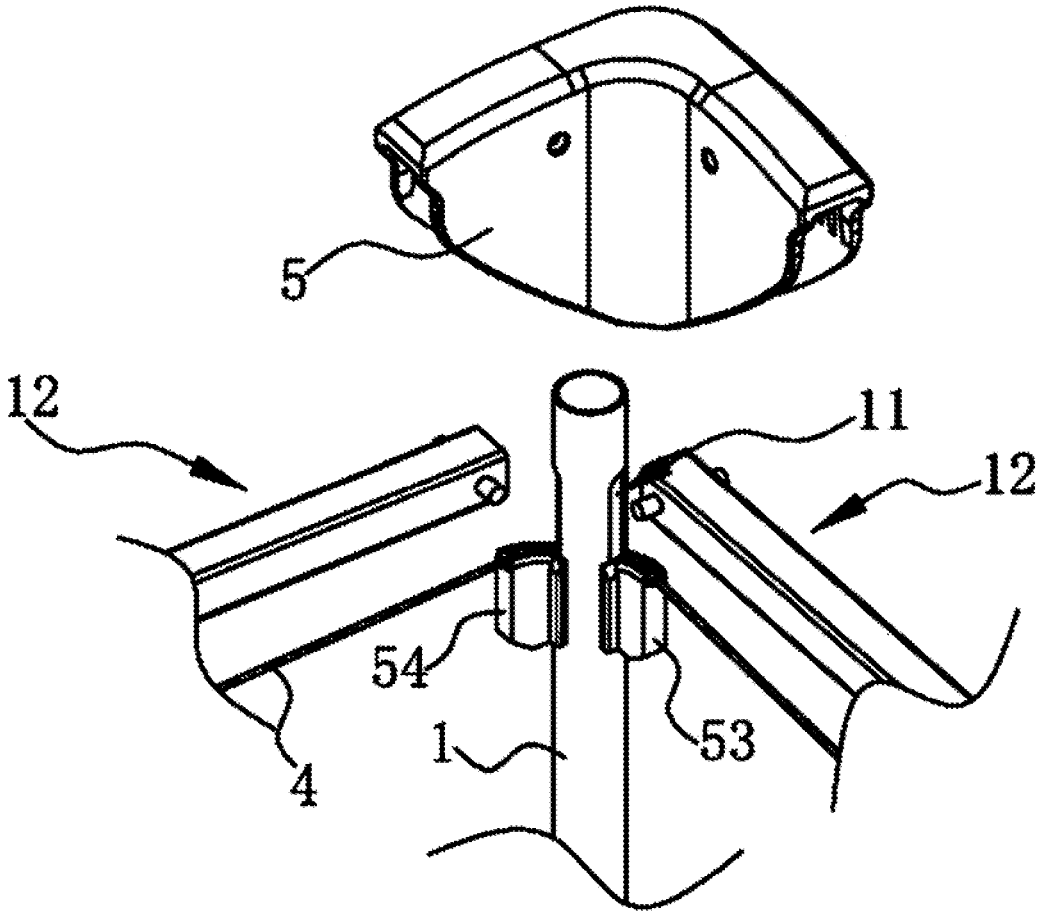
FIG. 27 is an exploded structural view of FIG. 26 from another view angle.
Figure 28:
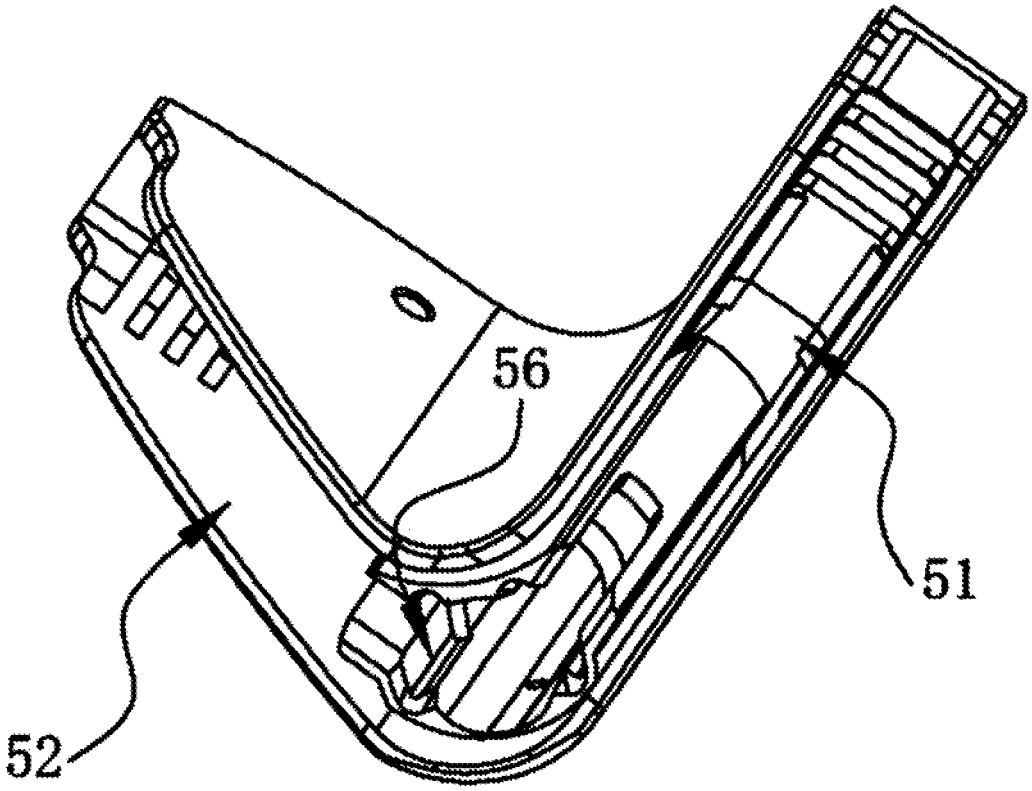
FIG. 28 is a perspective view of the connecting seat in FIG. 27 at another view angle.
Figure 29:
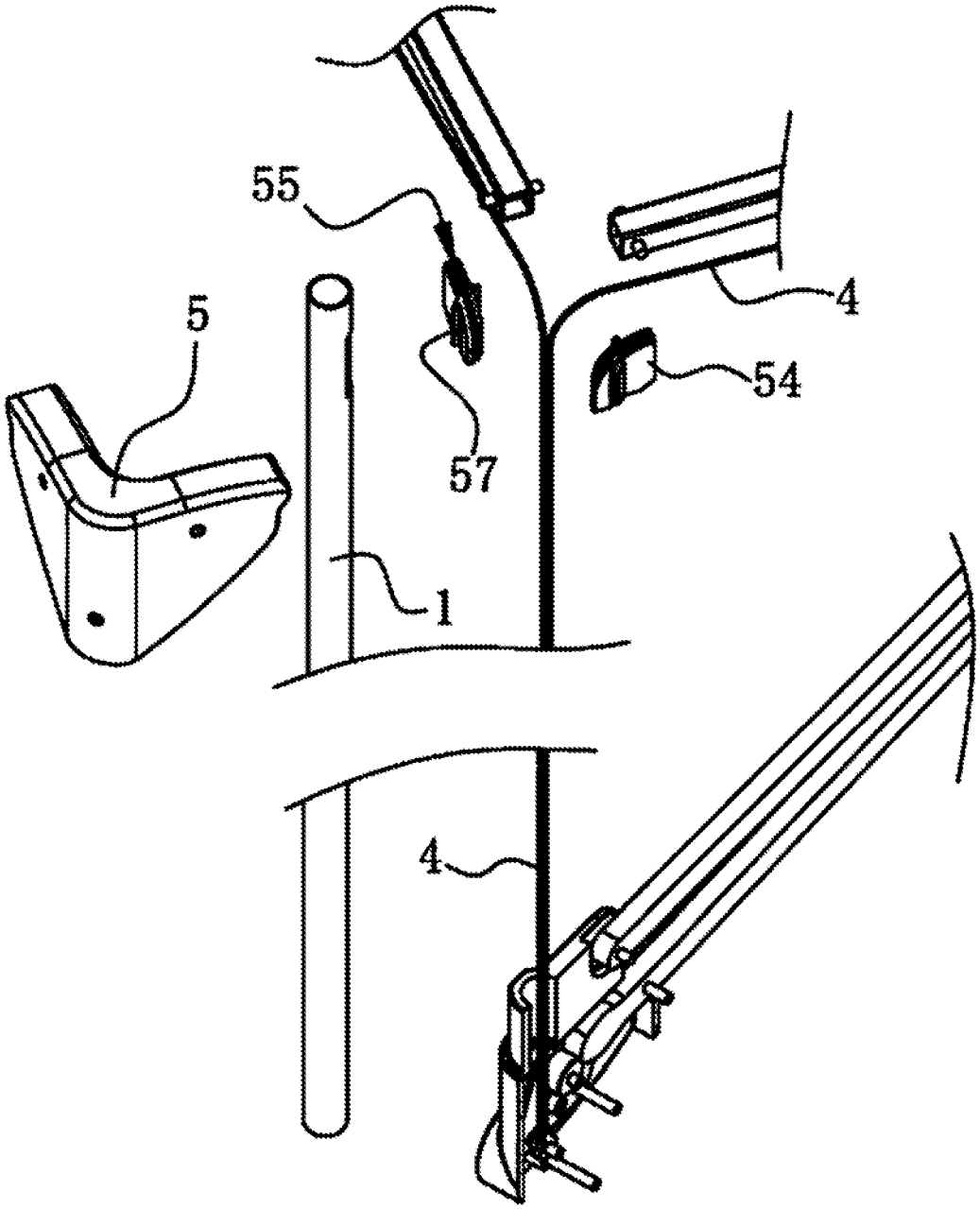
FIG. 29 is a further exploded structural view of FIG. 26

As shown in FIG. 18, the third type of transmission mechanism is a swing block (swinging block) 305. The lower part of the swing block 305 is swingingly disposed in the lower inner cavity 23 of the base 2 through the swing shaft 37. The lower shaft pin 231 is arranged on the inner cavity of the base at the upper right position of the swing shaft 37. The swing block 305 is provided with a roller body 340 that can abut with the arc-shaped end 32 of the lower connecting rod 31 so as to push the swing block 305 to swing left and right. The pull rope 4 and the roller body 340 located at the side position of the end of the lower connecting rod are connected with each other. A support wheel 306 for the pull rope 4 is provided in the inner cavity of the base at the right side of the swing shaft 37 and below the lower shaft pin 231. The pull rope 4 connected with the roller body 340 passes around the support wheel 306, and then passes around the swing shaft 37 to extend upward into the inner cavity of the bed leg 1. A rotating roller is rotationally sleeved on the swing shaft 37. The pull rope 4 is connected with the loop. The loop is sleeved on the roller body 340 of the swing block 305. The pull rope 4 passes around the support wheel 306 and then around the rotating roller to extend upward into the inner cavity of the bed leg 1. The roller body 340 and the end of the lower connecting rod can adopt a design similar to that of the first type of transmission mechanism to obtain a locking effect. As shown in FIG. 18, it shows a structure similar to the lower connecting rod of the first type of transmission mechanism and the position of the abutting when being locked. The corresponding structure can be obtained by combining the drawings and the specific structure of the first type of transmission mechanism, and therefore it will not be described in detail. The distance between the two points, the upper shaft pin 221 and the upper rotating shaft pin 222 on the upper connecting rod 21, is smaller than the distance between the two points, the lower shaft pin 231 and the lower rotating shaft pin 232 on the lower connecting rod 31. The bottom of the base 2 is provided with a roller 25 that facilitates the movement of the bed legs 1 back and forth. The bottom of the lower inner cavity 23 is provided with a third concave cavity 24, and the roller 25 is located in the third concave cavity 24.

The folding driving device comprises a frame body 6 that can move up and down relative to the bed legs 1, a guide rod 61 that is vertically fixed in the middle part of the frame body 6 and extends out downward from the middle part of the bottom surface of the frame body 6, and sliding seat 7 that can move up and down along the guide rod 61. The other ends of the upper connecting rod 21 and the lower connecting rod 31 movably connected to each leg of the bed are rotationally connected to the frame body 6 at corresponding positions through the upper rotating shaft pin 222 and the lower rotating shaft pin 232, respectively. The sliding seat 7 is movably connected with the corresponding lower connecting rod 31 through the transmission rod 38. The lower end of the transmission rod 38 is rotationally connected with the corresponding side surface of the sliding seat 7 through the lower transmission shaft pin 224. The upper end of the transmission rod 38 is rotationally connected with the lower connecting rod 31 through the upper transmission shaft pin 223. When the child game bed is fully unfolded, the upper transmission shaft pin 223 is located on the line connecting the upper rotating shaft pin 222 and the lower transmission shaft pin 224, or the upper transmission shaft pin 223 is located above or below the line connecting the upper rotating shaft pin 222 and the lower transmission shaft pin 224. The other end of the lower connecting rod 31 is rotationally connected with the frame body 6 through a lower rotating shaft pin 232. The positioning point of the lower rotating shaft pin 232 on the frame body 6 is located right oblique above the virtual point A and lower than the height of the upper rotating shaft pin 222. The virtual point A is connected with the upper shaft pin 221, the upper rotating shaft pin 222, and the lower shaft pin 231 to form a parallelogram, and the virtual point A is the fourth point position of the parallelogram. The angle a between the line connecting the positioning point of the lower rotating shaft pin 232 and the virtual point A and the horizontal line is 45°.

The frame body 6 is also provided with a locking mechanism that can maintain the open state when the bed body is fully opened. The locking mechanism comprises an unlocking drawbar 64 and a locking sheet. The unlocking drawbar 64 is placed, as being movable up and down, in the inner cavity of the guide rod 61. A vertical through hole 62, penetrating up and down, is provided at the center of the frame body 6. The guide rod 61 is inserted and fixed in the vertical through hole 62 of the frame body 6. The top surface of the guide rod 61 is flush with the top surface of the frame body. The lower end of the guide rod 61 extends out downward from the bottom surface of the frame body 6. An unlocking structure of the unlocking drawbar 64 is provided on the top surface of the frame body 6. The locking sheet is located in the inner cavity of the unlocking drawbar 64. When the folding driving device moves down to the lowest position to fully unfold the bed body, the locking sheet can extend out, through the corresponding side surfaces of the unlocking drawbar 64 and the guide rod 61, such that the locking sheet and the bottom surface of the sliding seat 7 are supported by each other and locked. When the bed body needs to be unlocked for being folded, the unlocking structure drives the locking sheet to retract into the inner cavity of the unlocking drawbar 64 to be disengaged from the sliding seat 7, so that the sliding seat 7 can be moved downward to be unlocked.

The locking sheet is located in the lower inner cavity of the unlocking drawbar 64. The locking sheet is composed of at least two positioning sheets 63, and the lower part of each positioning sheet 63 is provided with a connecting hole for allowing the horizontal shaft pin 66 to be inserted. An oblique strip hole 631 is provided on the positioning sheet 63 above the connecting hole. The positioning sheets 63 are folded together like a folding fan. The lower parts of the positioning sheets are connected together through the horizontal shaft pin 66 being inserted in the connecting hole, so that the positioning sheets 63 can be unfolded and folded left and right like a folding fan. The left and right ends of the horizontal shaft pin 66 are respectively fixed on the corresponding left and right side surfaces of the lower part of the guide rod 61. A folding pull shaft 65 that can move up and down in the oblique strip hole 631 to unfold and fold the positioning sheet 63 is inserted and arranged in the oblique strip hole 631. The left and right ends of the folding pull shaft 65 are radially fixed on the corresponding left and right side surfaces of the unlocking drawbar 64. The unlocking drawbar 64 is provided with a notch 641 that allows the positioning sheet to extend out from the side surface of the unlocking drawbar when the positioning sheet 63 is unfolded left and right. The left and right side surfaces of the guide rod 61 at positions corresponding to the notch 641 are also respectively provided with a through cavity 611 that allows the positioning sheet 63 to pass through the notch 641 when unfolded and then extend out of the side surface of the guide rod. The top surface of the positioning sheet 63 extending out from the through cavity 611 and the bottom surface of the sliding seat 7 can be supported by each other. Vertical waist-shaped holes 642 are respectively formed on the left and right side surfaces of the unlocking drawbar 64 at the upper part of the inner cavity in the middle part of the unlocking drawbar. A fixing shaft pin 68 is radially inserted and arranged in the waist-shaped hole 642. The left end of the fixing shaft pin 68 passes through the left side surface of the unlocking drawbar and is fixed together with the corresponding left side surface of the guide rod 61. The right end of the fixing shaft pin 68 passes through the right side surface of the unlocking drawbar and is fixed together with the corresponding right side surface of the guide rod 61. A return spring 71 is provided in the inner cavity of the unlocking drawbar above the notch 641. The bottom of the return spring 71 and the support part in the inner cavity of the unlocking drawbar above the notch 641 are supported by each other. The upper end of the return spring 71 can abut with the fixing shaft pin 68 to be supported by each other. The upper-lower hole distance L of the waist-shaped hole 642 is larger than the maximum distance K after the folding pull shaft 65 moves up and down to make the positioning sheet 63 completely folded. The unlocking structure comprises a pull ring 67 and a pull rope body. When the pull ring is selected, the two ends of the pull ring are connected with the rotatable pull shaft connected to the top surface of the unlocking drawbar 64.

Alternatively, the top of the frame body 6 is connected with a pull part 671 capable of pulling the frame body 6 upward. The unlocking structure is the pressing extending end of the unlocking drawbar extending out of the vertical through hole 62 or the pressing flushing end where the top surface of the unlocking drawbar is flush with the top surface of the vertical through hole 62. The locking sheet is located in the inner cavity in the middle part of the unlocking drawbar. The locking sheet is composed of at least two positioning sheets 63. The upper part of each positioning sheet 63 is provided with a connecting hole for allowing the horizontal shaft pin 66 to be inserted. An oblique strip hole 632 is provided on the positioning sheet 63 below the connecting hole. The positioning sheets 63 are folded together like a folding fan. The lower parts of the positioning sheets are connected together through the horizontal shaft pin 66 being inserted in the connecting hole, so that the positioning sheets 63 can be unfolded and folded left and right like a folding fan. The left and right ends of the horizontal shaft pin 66 are respectively fixed on the corresponding left and right side surfaces of the upper part of the guide rod 61. A folding pull shaft 65 that can move up and down in the oblique strip hole 632 to unfold and fold the positioning sheet 63 is inserted and arranged in the oblique strip hole 632. The left and right ends of the folding pull shaft 65 are radially fixed to the corresponding left and right side surfaces of the unlocking drawbar 64. The unlocking drawbar 64 is provided with a notch 641 that allows the positioning sheet to extend out of the side surface of the unlocking drawbar (pull rod) when the positioning sheet 63 is unfolded left and right. The left and right side surfaces of the guide rod 61 at positions corresponding to the notch 641 are also respectively provided with a through cavity 611 that allows the positioning sheet 63 to pass through the notch 641 when unfolded and then extend out from the side surface of the guide rod. The snapping surface of the positioning sheet 63 extending from the through cavity 611 can be snapped together with the bottom surface of the sliding seat 7. Vertical waist-shaped holes 642 are respectively formed on the left and right side surfaces of the unlocking drawbar 64 at the upper part of the inner cavity in the middle part of the unlocking drawbar. The horizontal shaft pin 66 is radially inserted and arranged in the waist-shaped hole 642. The inner cavity of the guide rod located below the through cavity 611 is provided therein with a return spring 71. The upper end of the return spring 71 abuts with the unlocking drawbar 64. The lower end of the return spring 71 and the support rod 69 located in the inner cavity of the guide rod are supported by each other. The upper-lower hole distance L of the waist-shaped hole 642 is larger than the maximum distance K after the folding pull shaft 65 moves up and down to make the positioning sheet 63 completely folded. After pressing the top of the unlocking drawbar 64, the locking sheet is driven to be retracted into the inner cavity of the unlocking drawbar 64, so as to be disengaged from the sliding seat 7. The pull part 671 is pulled upward, which can make the sliding seat 7 move downward to perform the unlocking.

The guard bar 12 comprises a left bar body 12*a* and a right bar body 12*b* that can be movably connected with the top of the corresponding bed leg 1, and a folding part located between the left bar body 12*a* and the right bar body 12*b* and capable of folding the left bar body 12*a* and the right bar body 12*b*. The folding part comprises a shell body 8, an elastic positioning body 9 located in the middle part of the inner cavity of the shell body 8, and a left turning part located on the left side of the elastic positioning body 9 and a right turning part located on the right side of the elastic positioning body 9. The right part of the left bar body 12*a* extends into the left inner cavity of the shell body, and is rotationally connected together with the shell body. The right end of the left bar body 12*a* is in transmission connection with the left turning part. The left turning part is connected with the pull rope 4 extending upwards from the base of the left bed leg. The left part of the right bar body 12*b* extends into the right inner cavity of the shell body, and is rotationally connected together with the shell body. The left end of the right bar body 12*b* is in transmission connection with the right turning part. The right turning part is connected with the pull rope 4 extending upwards from the base of the right bed leg.

Each turning part comprises a turning block 81 and a positioning block 82. The middle part of the turning block 81 is rotationally connected in the inner cavity of the corresponding shell body, through a turning block shaft pin 812. One end of the turning block 81 is movably connected with one end of the positioning block 82. The other end of the positioning block 82 is rotationally connected with the end of the corresponding left bar body 12*a* or right bar body 12*b*. The positioning block 82 is provided with a positioning protrusion 821 that can abut with the elastic positioning body 9.

The positioning block 82 is composed of two positioning sheet bodies in the same shape. The two positioning sheet bodies are symmetrically arranged. One end of the corresponding turning block 81 is clamped between one ends of the two positioning sheet bodies, and the one ends can be relatively movably connected together by the rotating shaft 84. The end of the corresponding left or right bar bodies 12*a*, 12*b* is clamped between the other ends of the two positioning sheet bodies, and the other ends mutually rotationally connected together by the sheet body shaft pin 813. One end of the corresponding pull rope 4 passes around the arc-shaped side wall of the corresponding turning block 81 and is connected together with the rotating shaft 84.

The elastic positioning body 9 comprises a compression spring 91 and a compression rod 92 capable of abutting with the positioning protrusion 821. Two spring cavities 93 in which corresponding compression springs 91 are placed are provided on the elastic positioning body 9. One end of the compression spring 91 placed in the spring cavity 93 respectively abuts against the bottom surface of the corresponding spring cavity 93. The other end of the compression spring 91 abuts with the corresponding compression rod 92, respectively. A position-limiting waist-shaped through hole 83 is respectively provided on the side wall of the shell body at a position corresponding to the compression spring 91. The compression rod 92 is inserted and arranged in the corresponding position-limiting waist-shaped through hole 83. When the guard bar 12 is unfolded, the compression rod 92 and the positioning protrusion 821 on the positioning block 82 can be supported by each other. At this time, the corresponding group of the sheet body shaft pin 813, the rotating shaft 84, and the turning block shaft pin 812 are located on one straight line from top to bottom, as a line connecting three points. When the guard bar 12 is folded, the compression rod 92 pushes the positioning protrusion 821 to unlock the rotating shaft 84. The positioning block 82 rotates to separate the compression rod 92 from the positioning protrusion 821. The side wall of the elastic positioning body 9 corresponding to the spring cavity 93 is provided with a side wall notch 94 capable of accommodating the corresponding compression rod 92. The arc-shaped side wall of the turning block 81 is provided, at intervals, with hook-shaped protrusions 811 that can be snapped into the corresponding pull rope 4. A position-limiting groove 814 capable of allowing the corresponding pull rope 4 to be embedded is provided on the arc-shaped side surface of the turning block 81. Rope body of the corresponding the pull rope 4 is located in the position-limiting groove 814.

A left pull rope spring 41 is connected to pull rope 4 under the left bar body 12*a*. One end of the left pull rope spring 41 is connected with the outer end of pull rope 4 on the left turning block. The other end of the left pull rope spring is connected together with the transmission mechanism in the corresponding base 2 through the pull rope passing downwards through the inner cavity of the left bed leg 1. A right pull rope spring is connected to the pull rope 4 under the right bar body 12*b*. One end of the right pull rope spring is connected with the outer end of the pull rope 4 on the right turning block. The other end of the right pull rope spring is connected together with the transmission mechanism in the corresponding base 2 through the pull rope passing downwards through the inner cavity of the right bed leg 1. The lowest end B of the pull rope 4 connected with the folding part is lower than the position of the extending-in point C which the pull rope 4 extends into the inner cavity of the corresponding bed leg. The steel wire rope is arranged obliquely, so that the pull rope 4 has a lifting-upward effect on the folding part, so that the folding part located in the middle part of the guard bar can be opened more easily. In addition, the pull rope 4 has an upward component force on the folding part, which has a lifting effect.

The bed leg 1 is of a hollow structure. The pull rope 4 extends into the bed leg 1 and extends out from the opening of the side wall of the upper part of the bed leg 1 so as to be connected to the middle part of the guard bar 12. When the child game bed is fully unfolded, the included angle between the upper connecting rod 21 and the lower connecting rod 31 is 1.5-4°. An auxiliary support rod 601 capable of rotating relative to the frame body 6 is provided on the frame body 6. The auxiliary support rod 601 is L-shaped. When the bed leg 1 is fully opened, the end of the L-shaped auxiliary support rod 601 abuts against the ground. The other end of the pull rope 4 passes through the inner cavity of the bed leg and extends out from the inner cavity of the upper part of the bed leg to be connected with the folding part. The transmission mechanism can be connected with the folding part of the middle part of the guard bar 12 on the top of the child game bed through the pull rope 4. The arc-shaped end 32 is an elliptical end.

A connecting seat 5 is provided on the top of the bed leg of the child game bed. The top projection view of the connecting seat 5 is in an "L" shape. A left groove 51 and a right groove 52 are provided on the left and right sides of the connecting seat 5, with the left groove and the right groove capable of allowing the corresponding ends of the left guard bar and the right guard bar to extend therein to be movably connected with each other. The left guard bar can swing up and down in the left groove 51, and the right guard bar can swing up and down in the right groove 52. Two side-wall through holes 11, having equal height and being spaced apart, are provided on the side wall of the bed leg 1, at the position of the inner cavity of the connecting seat. A left wire block 53 is snapped on the left side-wall through hole. A left lead groove 55 is provided on the top of the left wire block 53, wherein the pull rope 4 can be movably embedded in the left lead groove, with the pull rope penetrating from the left groove 51, and then passing through the left side-wall through hole to extend into the inner cavity of the bed leg to reach the bottom of the bed leg. A right wire block 54 is snapped on the right side-wall through hole. A right lead groove is provided on the top of the right wire block 54, wherein the pull rope 4 can be movably embedded in the right lead groove, with the pull rope penetrating from the right groove 52, and then passing through the left side-wall through hole to extend in the inner cavity of the bed leg to reach the bottom of the bed leg. Left lugs 57 are protrudingly provided on the left and right surfaces of the left wire block 53, with the left lugs capable of being snapped and fixed with the corresponding inner wall snapping groove 56 of the connecting seat 5 at the position of the left groove 51. Right lugs are protrudingly provided on the left and right surfaces of the right wire block 54, with the right lugs capable of being snapped and fixed with the corresponding inner wall snapping groove 56 of the connecting seat 5 at the position of the right groove 52. A sleeve insertion cavity is vertically arranged at the corner of the inner cavity of the connecting seat 5. The top of the bed leg 1 is inserted into the sleeve insertion cavity and fixed with the connecting seat 5.

The left guard bar is rotationally connected with the connecting seat 5 through a left rotating shaft. The right guard bar is rotationally connected with the connecting seat 5 through a right rotating shaft. Bolt holes or screw holes are provided on the inner and outer side surfaces of the corners of the connecting seat 5, which can enhance the fixation fastness with the tops of the bed legs by means of the bolts transversely passing through or the screws being transversely inserted into the inner cavity of the connecting seat. The groove bottom surface of the left lead groove 55 is an arc groove in the arc shape. The groove bottom surface of the right lead groove is also an arc groove in the arc shape. The connecting seat 5 is of an integral structure which is made of plastic and formed by one-time injection molding.

INDUSTRIAL APPLICABILITY

Working Principle: When the child game bed is in a folded state, the folding driving device is pressed to move downward. During the four-bar linkage mechanism composed of upper and lower connecting rods drives the bed legs to move outward, the bed legs are gradually tilted to the outside to present an inclined unfolding in which the tops of the bed legs are unfolded quickly and the bottoms of the bed legs are unfolded slowly. The arc-shaped end 32 of the lower connecting rod pushes the transmission roller 34 to make the swing block 3 swing in a counterclockwise direction, to drive the connecting shaft 36 to move downward in an arc shape, so that the pull rope 4 is pulled downward, to drive the guard bar to be locked. When the top is fully unfolded, the folding driving device continues moving downwards, so that the connecting rod continues pushing the bottoms of the bed legs to unfold outwards until the bottoms of the bed legs are fully unfolded to a normal use state. When the folding driving device pulls up the child game bed body, the above steps are performed reversely.

The entire unfolding and folding process will be described in detail below with reference to the drawings.

Figure 7:
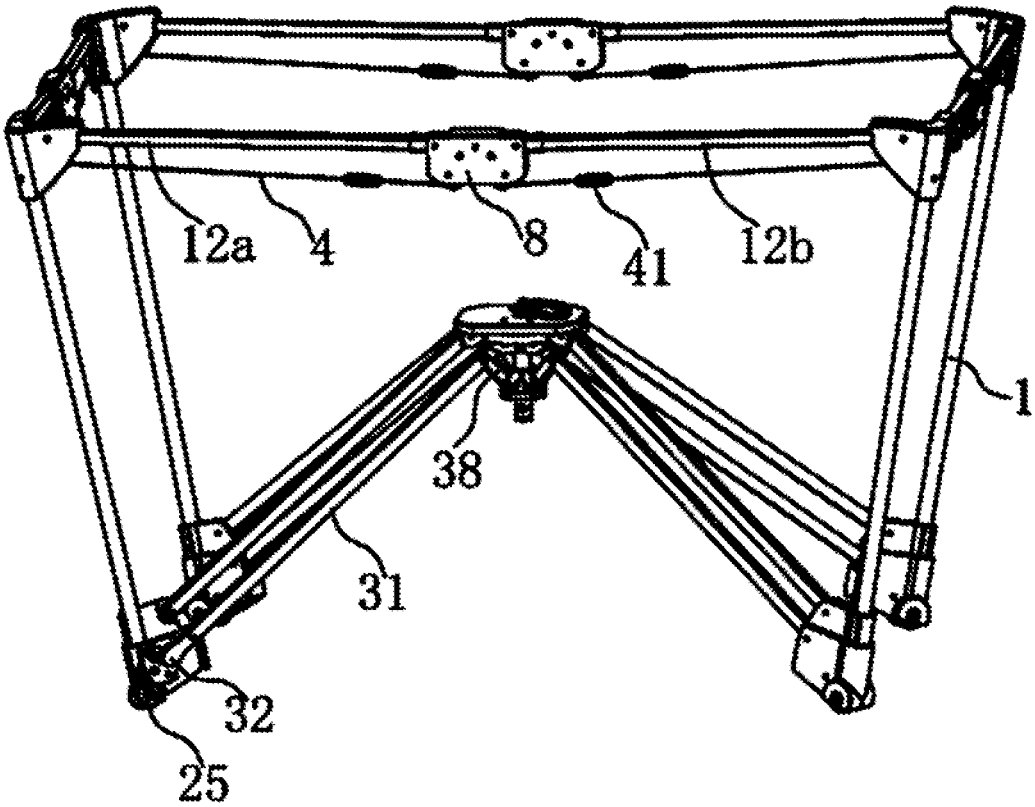
FIG. 7 is a perspective view of FIG. 2 after being folded.
Figure 8:
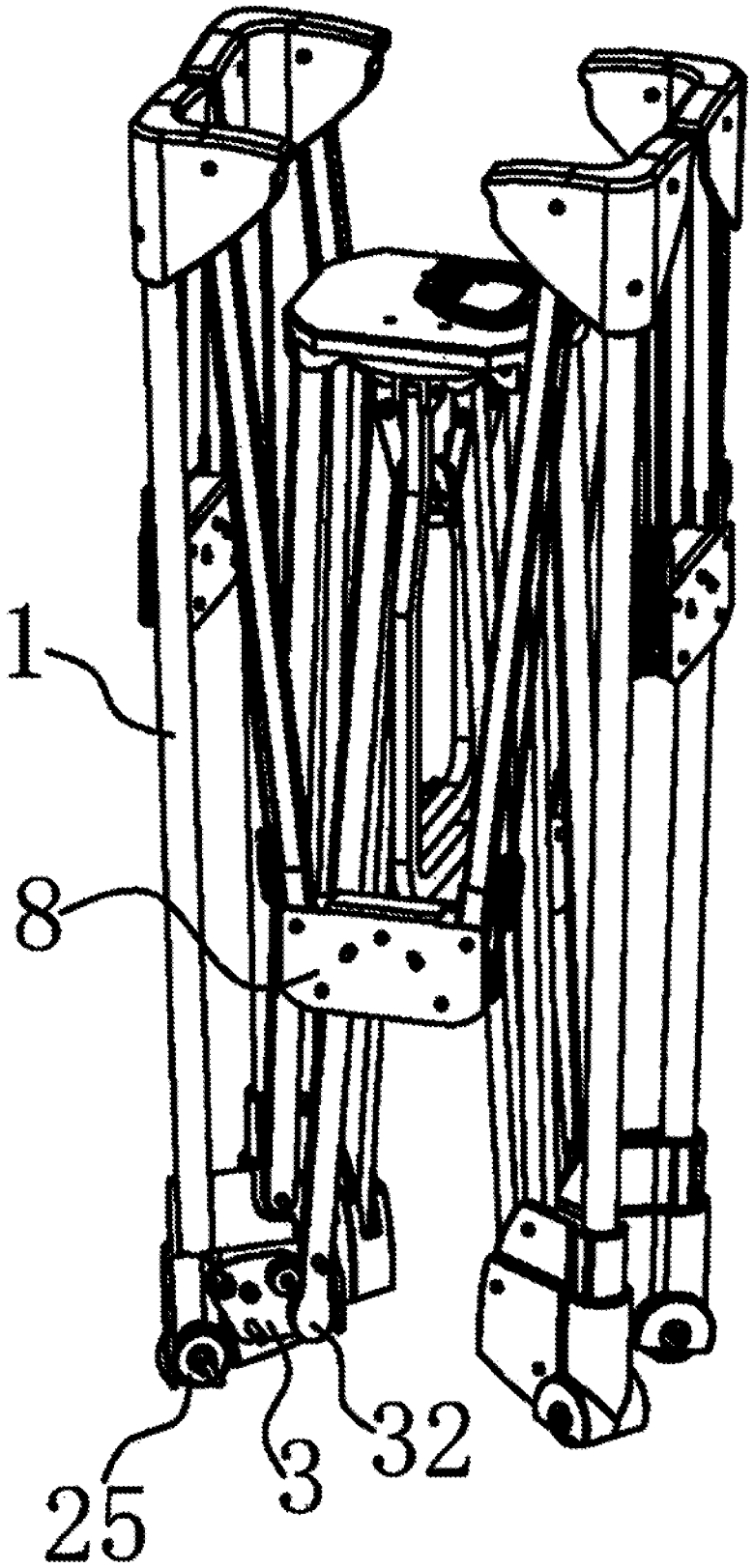
FIG. 8 is a perspective view of FIG. 7 after continuing to fold until the folding is completed.

The unfolding process of the present application is shown in FIG. 8→FIG. 7→FIG. 1.

Figure 5:
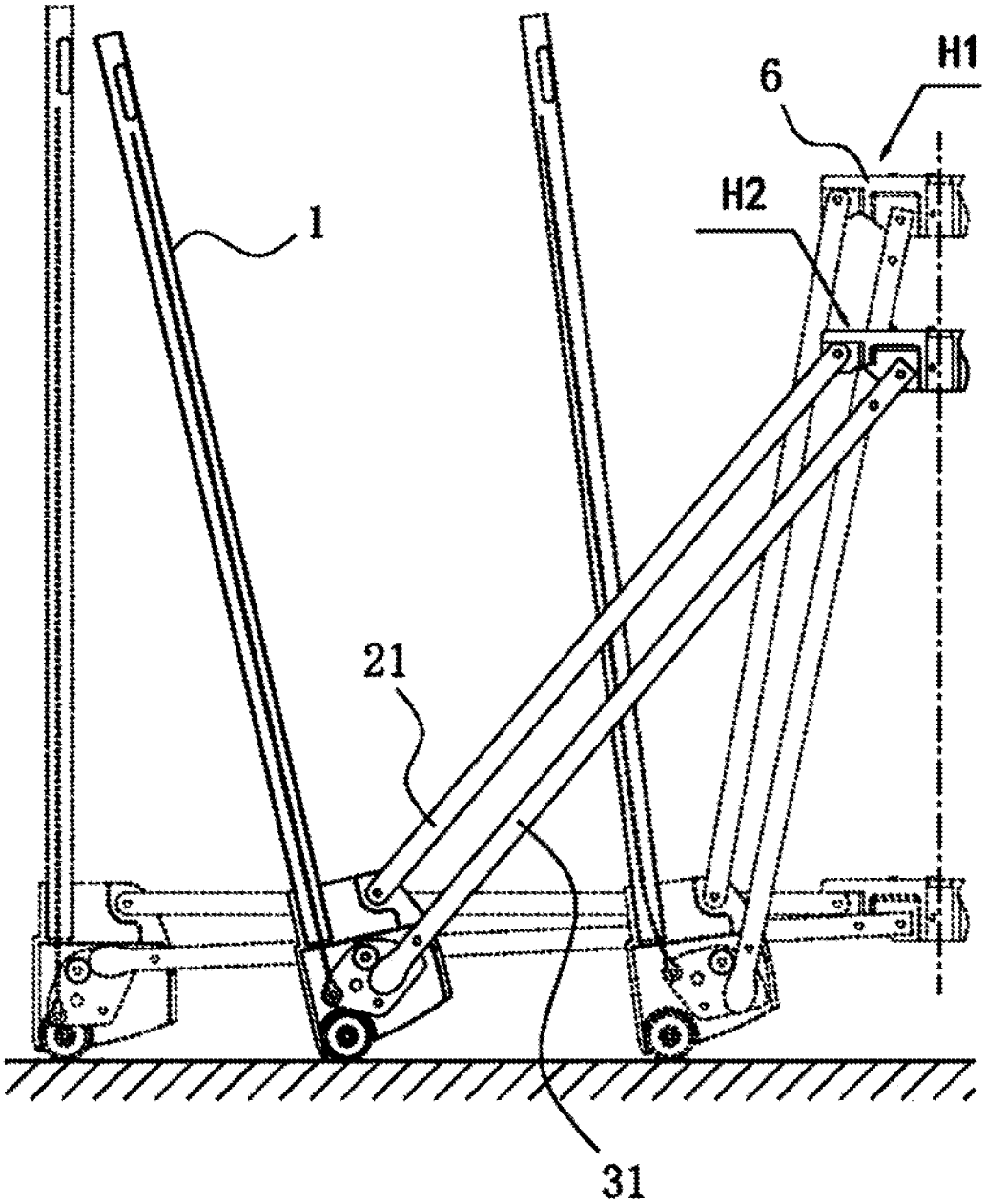
FIG. 5 is a schematic structural view showing that the connecting rods in FIG. 4 and the folding driving device, the base, and the bed legs move to different positions.
Figure 6:
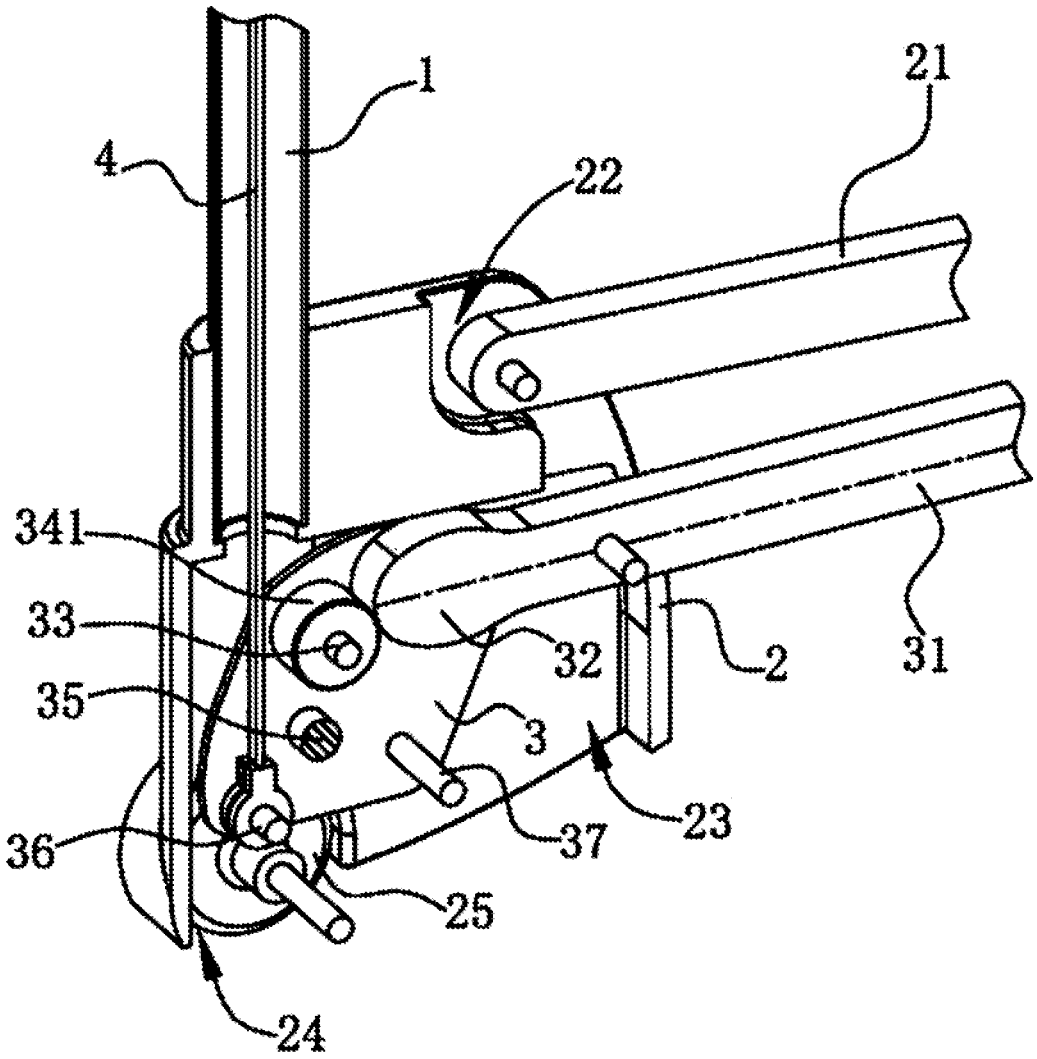
FIG. 6 is a schematic structural view showing that a half of the swing block is cut off from the base with a half of shell removed in FIG. 2.
Figure 9:
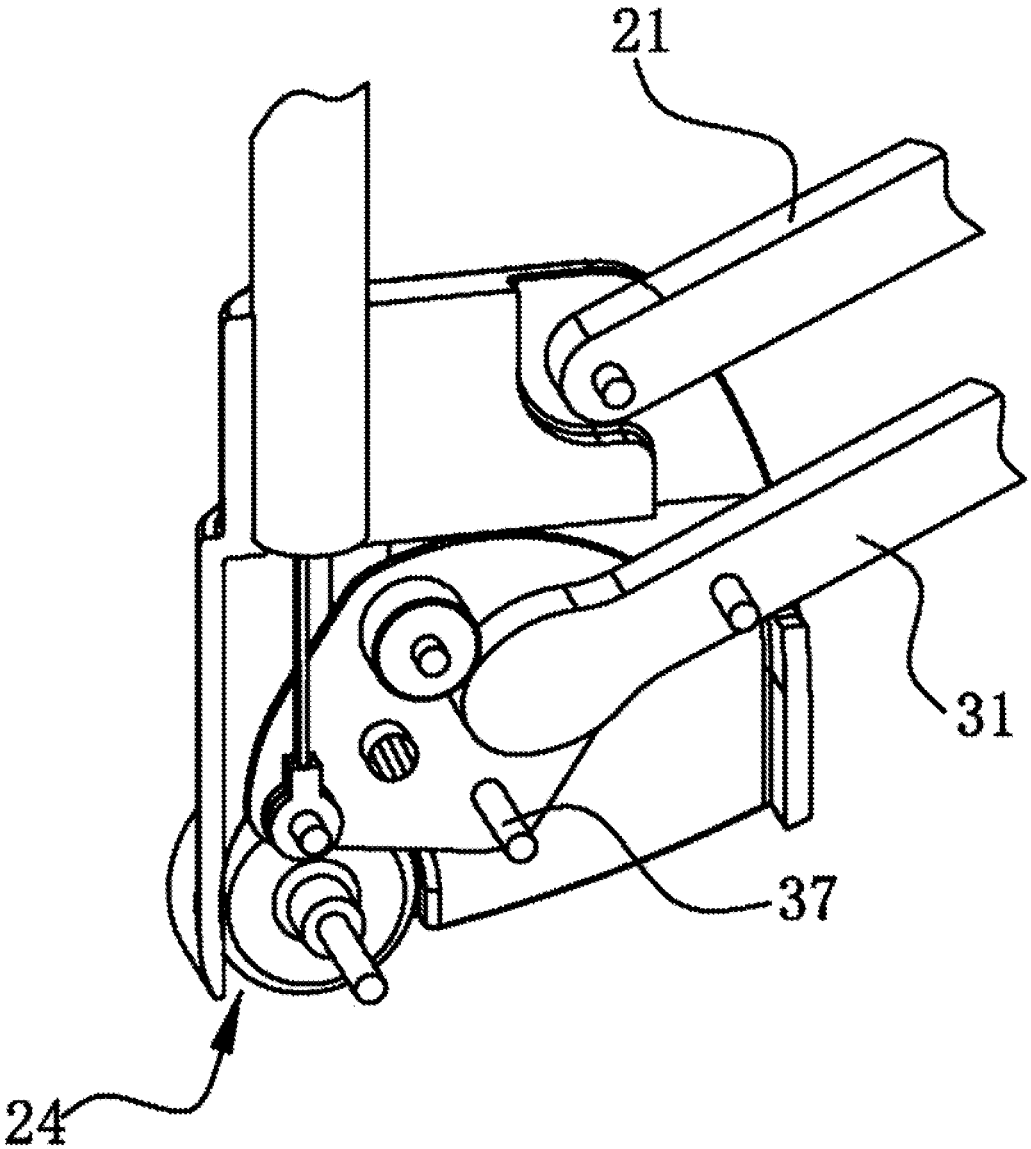
FIG. 9 is a schematic structural view showing the positional relationship between the transmission roller and the arc-shaped end in FIG. 7.

Unfolding Process: When the folding bed is in the folded state, the folding driving device is at the highest point of the positions which it passes through during its displacement. The upper connecting rod 21 rotates upward to a vertical position, and the left and right bar bodies of all guard bars rotate downward to fold the guard bars, as shown in FIG. 8. The folding driving device is pressed down and the folding driving device drives the upper connecting rod 21 and the lower connecting rod 31 to rotate. The upper connecting rod 21 and the lower connecting rod 31, when rotating to drive the base 2 and the bed legs 1 to move outward (away from the center), gradually incline to the outside, and synchronously drive the left and right bar bodies to rotate (as shown in the H1 position in FIG. 5) until that the upper connecting rod 21 and the lower connecting rod 31 are substantially parallel. At this time, the bed legs 1 are at the maximum inclination angle (the position H2 as shown in FIG. 5). The folding driving device is continuously pressed down. The upper connecting rod 21 and the lower connecting rod 31, when rotating to drive the base 2 and the bed legs 1 to move to the outside, gradually incline to the inside. At this time, the bed legs 1 pull the connecting seats 5 of the tops of the corresponding bed legs 1 outward to move the connecting seats 5 away from each other, and the guard bar 12 is driven to be unfolded to a nearly horizontal state, as shown in FIG. 7. The folding driving device is continuously pressed down. The folding driving device drives the upper connecting rod 21 and the lower connecting rod 31 to rotate. The arc-shaped end 32 of the lower connecting rod 31 pushes the transmission roller 34 to make the swing block 3 swing in a counterclockwise direction, as shown in FIG. 9. The connecting shaft 36 is driven to move downward in an arc shape, so that the pull rope 4 is pulled downward to drive the corresponding guard bar 12 to be unfolded to a horizontal use state, and the folding part is locked. The folding driving device is continuously pressed down until that the child foldable bed is fully opened. The upper connecting rod 21 and the lower connecting rod 31, when rotating to drive the base 2 and the bed legs 1 to move outward, gradually incline inward to a vertical state, as shown in FIG. 1. During this process, the connecting shaft 36 continues moving downward in an arc shape to pull the pull rope 4 downward, so that the pull rope spring is in a stressed state, ensuring the folding part is always in a constant force state. The pull rope spring plays a tensioning role. Here, if the pull rope spring is not used, very high requirements will be applied to the manufacturing and processing of the pull rope 4. It is difficult to guarantee the processing accuracy of the length of the pull rope 4 using a general production process. If the length of the pull rope 4 between the connecting shaft 36 and the rotating shaft 84 is longer slightly, the turning part of the folding part cannot be pulled in time, so that the folding part is not in the locked state. If the length of the pull rope 4 between the connecting shaft 36 and the rotating shaft 84 is shorter slightly, the transmission mechanism in the inner cavity of the base 2, that can pull the pull rope 4, causes the pull rope to be stressed, which will exceed the maximum load force of the pull rope and make the pull rope fractured. Moreover, the elastic force of the pull rope spring is far greater than the elastic force of the compression spring 91 on the elastic positioning body 9. During the process that the transmission mechanism in the inner cavity of the base 2 which can pull the pull rope 4 drives the folding part to be locked, firstly the guard bars are unfolded overcoming the gravity of the guard bars, and at the same time overcoming the elastic resistance of the compression spring 91, the pull rope 4 tightens the corresponding turning part and drives the turning part such that the corresponding group of the sheet body shaft pin 813, the rotating shaft 84, and the turning block shaft pin 812, as three points being connected in a line, are located on a straight line from the top to the bottom, so that the folding part is locked. Afterwards, the transmission mechanism continuously drives the pull rope 4 to make the tension spring in a tensioned state. The locking sheet extends after passing through the corresponding side surfaces of the unlocking drawbar 64 and the guide rod 61, and the locking sheet and the bottom surface of the sliding seat 7 are supported by each other, so as to be locked. So far, the folding bed is in a fully opened and locked state.

The folding process of the present application is shown in FIG. 1→FIG. 7→FIG. 8.

Folding Process: When the folding bed is in the unfolded state, as shown in FIG. 1, the pull ring 67 on the folding driving device can be lifted up with only one hand. The folding driving device is unlocked by the unlocking mechanism to allow the folding driving device to continuously move in the upward direction. The pull ring 67 is continuously lifted, and the folding driving device drives the upper connecting rod 21 and the lower connecting rod 31 to rotate. The upper connecting rod 21 and the lower connecting rod 31, when rotating to drive the base 2 and the bed legs 1 to move inward, gradually incline to the outside. The end surface of the arc-shaped end 32 of the lower connecting rod 31, around the transmission roller 34, moves away from the shaft center of the transmission roller, so that the pull rope 4 gradually loses its pulling force. The elastic positioning body 9 in the folding part pushes the corresponding turning part to rotate, so that the folding part is unlocked and the guard bar is folded, as shown in FIG. 7. The pull ring 67 is continuously lifted, and the guard bar drives the corresponding bed leg 1 to continue moving closer to the folding driving device. The left and right bar bodies of the guard rod 12 rotate downward to a vertical position. So far, this folding bed is in a folded state, as shown in FIG. 8.

By skillfully designing the connecting positions of the upper connecting rod 21 and the lower connecting rod 31 to form the four-bar linkage mechanism, when this folding bed is unfolded, the bed legs 1 can produce a motion track in which it firstly tilts outward and then returns to the vertical. It can be divided into two stages of unfolding process. When the bed body is just unfolded, the unfolding range of the upper ends of the bed legs is greater than that of the lower ends of the bed legs. The bed legs are inclined to the outside, so that the guard bars on the upper part of the bed body can be in place first. Thereby, the guard bar of the bed body can be pre-positioned. During the process that the bed body is continuously unfolded, the lower ends of the bed legs are continuously unfolded to the range as the upper ends thereof, and the bed legs return to the vertical normal use state again, realizing the complete unfolding of the bed body. The design of this mechanism facilitates the unfolding of the guard bar, thereby realizing the opening and closing of the folding bed by a single person.

It is obvious that the present application has the significantly advantageous feature, that is, one-step operation. The pushing down or lowering of the folding driving device makes the bed body open, and the pulling up or lifting of the folding driving device makes the bed body folded. When the bed body is opened and folded, the movement of the folding driving device in any direction can simultaneously cause the movements of all other components and structures of the bed body.

What is claimed is:

1. A portable child game bed, comprising four bed legs and a folding driving device which is placed in a middle part of a bottom of the bed and capable of folding and unfolding a bed body, wherein guard rods are respectively arranged at tops between adjacent two bed legs with each of the guard rods having a middle part foldable; two ends of each of the guard rods are respectively movably connected to tops of corresponding bed legs; a connecting mechanism is provided at a bottom of each of the bed legs with the connecting mechanism movably connected with a folding driving device through connecting rods; each of the connecting rods is composed of an upper connecting rod and a lower connecting rod arranged up and down, wherein the connecting mechanism comprises a base, and a transmission mechanism which is arranged in an inner cavity of the base, wherein one end of the upper connecting rod extends into an upper inner cavity of the base and is rotationally connected with the base by an upper shaft pin, the other end of the upper connecting rod is rotationally connected with a frame body in the folding driving device by an upper rotating shaft pin, and one end of the lower connecting rod extends into a lower inner cavity of the base and is rotationally connected with the base by a lower shaft pin, and the end of the lower connecting rod that extends into the lower inner cavity of the base is linked with the transmission mechanism together, the lower shaft pin is located below the upper shaft pin and rotationally connected with the base, and the other end of the lower connecting rod is rotationally connected with the frame body by a lower rotating shaft pin, wherein the transmission mechanism is a swing block, and the swing block is swingingly arranged in the lower inner cavity of the base through a swing shaft; the lower shaft pin is arranged in the inner cavity of the base at an upper right position of the swing block; the swing block is provided thereon with a transmission roller which can abut with an end of the lower connecting rod so as to push the swing block to swing to the left and a connecting shaft that can be connected with a pull rope; the swing shaft is arranged on a lower position of the swing block at a lower left position of the lower shaft pin; and the connecting shaft connected with the pull rope is fixed on a left side of the swing shaft.

2. The portable child game bed according to claim 1, wherein the transmission mechanism comprises a first swing connecting rod and a second swing connecting rod, wherein one ends of the first swing connecting rod and the second swing connecting rod are folded in a Chinese character "人" shape and connected together in a manner that they can be rotated relatively to each other through a movable pin; the other end of the first swing connecting rod is rotationally connected to an end of the lower connecting rod through a rotation pin, and the other end of the second swing connecting rod is movably connected with the base through a positioning pin shaft; and the pull rope extending into in the base is connected with the movable pin.

3. The portable child game bed according to claim 2, wherein the folding driving device comprises a frame body that can move up and down relative to the bed legs, a guide rod which is vertically fixed on a middle part of the frame body and extends out downwards from a middle part of a bottom surface of the frame body, and a sliding seat that can move up and down along the guide rod, wherein the other ends of the upper connecting rod and the lower connecting rod, which are movably connected to each bed leg, are respectively rotationally connected with the frame body at corresponding positions, through the upper rotating shaft pin and the lower rotating shaft pin; and the sliding seat is movably connected with a corresponding lower connecting rod through a transmission rod.

4. The portable child game bed according to claim 2, wherein the guard bar comprises a left bar body and a right bar body which can be movably connected with tops of corresponding bed legs and a folding part located between the left bar body and the right bar body and capable of folding the left bar body and the right bar body; the folding part comprises a shell body, an elastic positioning body located in a middle part of an inner cavity of the shell body, and a left turning part on a left side of the elastic positioning body and a right turning part on a right side of the elastic positioning body; a right part of the left bar body extends into a left inner cavity of the shell body to be rotationally connected with the shell body; a right end of the left bar body is in transmission connection with the left turning part; the left turning part is connected with a pull rope extending upward from the base of left bed legs; a left part of the right bar body extends into a right inner cavity of the shell body to be rotationally connected with the shell body; a left end of the right bar body is in transmission connection with the right turning part; and the right turning part is connected with a pull rope extending upward from the base of right bed legs.

5. The portable child game bed according to claim 1, wherein the transmission mechanism is a swing block; a lower part of the swing block is swingingly arranged in the lower inner cavity of the base through a swing shaft; the lower shaft pin is arranged on an inner cavity of the base at a upper right position of the swing shaft; the swing block is provided thereon with a roller body that can abut with an arc-shaped end of the lower connecting rod so as to push the swing block to swing left and right; the pull rope is connected with the roller body located at a side position of the end of the lower connecting rod; a support wheel for the pull rope is provided in the inner cavity of the base on a right side of the swing shaft and below the lower shaft pin; and the pull rope connected with the roller body bypasses the support wheel, and then bypasses the swing shaft to extend upward into an inner cavity of the bed legs.

6. The portable child game bed according to claim 5, wherein the folding driving device comprises a frame body that can move up and down relative to the bed legs, a guide rod which is vertically fixed on a middle part of the frame body and extends out downwards from a middle part of a bottom surface of the frame body, and a sliding seat that can move up and down along the guide rod, wherein the other ends of the upper connecting rod and the lower connecting rod, which are movably connected to each bed leg, are respectively rotationally connected with the frame body at corresponding positions, through the upper rotating shaft pin and the lower rotating shaft pin; and the sliding seat is movably connected with a corresponding lower connecting rod through a transmission rod.

7. The portable child game bed according to claim 5, wherein the guard bar comprises a left bar body and a right bar body which can be movably connected with tops of corresponding bed legs and a folding part located between the left bar body and the right bar body and capable of folding the left bar body and the right bar body; the folding part comprises a shell body, an elastic positioning body located in a middle part of an inner cavity of the shell body, and a left turning part on a left side of the elastic positioning body and a right turning part on a right side of the elastic positioning body; a right part of the left bar body extends into a left inner cavity of the shell body to be rotationally connected with the shell body; a right end of the left bar body is in transmission connection with the left turning part; the left turning part is connected with a pull rope extending upward from the base of left bed legs; a left part of the right bar body extends into a right inner cavity of the shell body to be rotationally connected with the shell body; a left end of the right bar body is in transmission connection with the right turning part; and the right turning part is connected with a pull rope extending upward from the base of right bed legs.

8. The portable child game bed according to claim 1, wherein the folding driving device comprises the frame body that can move up and down relative to the bed legs, a guide rod which is vertically fixed on a middle part of the frame body and extends out downwards from a middle part of a bottom surface of the frame body, and a sliding seat that can move up and down along the guide rod, wherein the other ends of the upper connecting rod and the lower connecting rod, which are movably connected to each bed leg, are respectively rotationally connected with the frame body at corresponding positions, through the upper rotating shaft pin and the lower rotating shaft pin; and the sliding seat is movably connected with a corresponding lower connecting rod through a transmission rod.

9. The portable child game bed according to claim 8, wherein a lower end of the transmission rod is rotationally connected with a corresponding side surface of the sliding seat through a lower transmission shaft pin, and an upper end of the transmission rod is rotationally connected with the lower connecting rod through an upper transmission shaft pin.

10. The portable child game bed according to claim 9, wherein the frame body is further provided with a locking mechanism that can maintain an opening state when the bed body is completely opened; the locking mechanism comprises an unlocking drawbar and a locking sheet; the unlocking drawbar is placed in an inner cavity of the guide rod in a manner of being capable of moving up and down; a vertical through hole penetrating up and down is provide at a center of the frame body; the guide rod is inserted and fixed in the vertical through hole of the frame body; a top surface of the guide rod is flush with a top surface of the frame body and a lower end of the guide rod extends out downward from a bottom surface of the frame body; an unlocking structure of the unlocking drawbar is provided on the top surface of the frame body; the locking sheet is located in an inner cavity of the unlocking drawbar; when the folding driving device moves down to a lowest position to completely unfold the bed body, the locking sheet can extend out, after passing through corresponding side surfaces of the unlocking drawbar and the guide rod, such that the locking sheet and a bottom surface of the sliding seat are supported by each other and locked; and when the bed body needs to be folded and unlocking is to be performed, the unlocking structure drives the locking sheet to retract into the inner cavity of the unlocking drawbar to be disengaged from the sliding seat, enabling the sliding seat to move down to performing the unlocking.

11. The portable child game bed according to claim 10, wherein the locking sheet is located in a lower inner cavity of the unlocking drawbar; the locking sheet is composed of at least two positioning sheets; a lower part of each positioning sheet is provided with a connecting hole for allowing a horizontal shaft pin to be inserted; the positioning sheet above the connecting hole is provided with an oblique strip hole; the positioning sheets are folded together like a folding fan; lower parts of the positioning sheets are connected together by the horizontal shaft pin being inserted through connecting holes such that the positioning sheets can be unfolded and folded left and right like a folding fan; left and right ends of the horizontal shaft pin are respectively fixed on corresponding left and right side surfaces of a lower part of the guide rod; a folding pull shaft is inserted and arranged in the oblique strip hole, with the folding pull shaft capable of moving up and down in the oblique strip hole to unfold and fold the positioning sheets; left and right ends of the folding pull shaft are radially fixed on corresponding left and right side surfaces of the unlocking drawbar; the unlocking drawbar is provided with a notch which allows the positioning sheets to extend out from a side surface of the unlocking drawbar when the positioning sheets are unfolded left and right; through cavities are respectively provided on left and right sides of the guide rod at a position corresponding to the notch with the through cavities allowing the positioning sheets to extend out from a side surface of the guide rod after passing through the notch when the positioning sheets are unfolded; top surfaces of the positioning sheets extending out from the through cavities and a bottom surface of the sliding seat can be supported by each other; vertical waist-shaped holes are respectively formed on left and right side surfaces of the unlocking drawbar in an upper part of an inner cavity at a middle part of the unlocking drawbar; a fixing shaft pin is radially inserted and arranged in the waist-shaped holes; a left end of the fixing shaft pin passes through a left side surface of the unlocking drawbar to be fixed together with a corresponding left side surface of the guide rod; a right end of the fixing shaft pin passes through a right side surface of the unlocking drawbar to be fixed together with a corresponding right side surface of the guide rod; a return spring is provided in the inner cavity of the unlocking drawbar located above the notch; a bottom of the return spring and a support part in the inner cavity of the unlocking drawbar above the notch are supported by each other, an upper end of the return spring and the fixing shaft pin can abut with and be supported by each other; and each of the waist-shaped holes has a upper-lower hole distance which needs to be greater than a maximum distance after the folding pull shaft moves up and down to make the positioning sheets completely folded.

12. The portable child game bed according to claim 10, wherein a top of the frame body is connected with a pull part that can pull the frame body upward; the unlocking structure is a pressing protruding end of the unlocking drawbar extending out from the vertical through hole or a pressing flushing end where a top surface of the unlocking drawbar is flush with a top surface of the vertical through hole; the locking sheet is located in the inner cavity of the middle part of the unlocking drawbar; the locking sheet is composed of at least two positioning sheets; a upper part of each positioning sheet is provided with a connecting hole for allowing a horizontal shaft pin to be inserted; the positioning sheet below the connecting hole is provided with an oblique strip hole; the positioning sheets are folded together like a folding fan; upper parts of the positioning sheets are connected together through the horizontal shaft pin being inserted in the connecting hole, so that the positioning sheets can be unfolded and folded left and right like a folding fan; left and right ends of the horizontal shaft pin are respectively fixed on corresponding left and right side surfaces of an upper part of the guide rod; a folding pull shaft is inserted and arranged in the oblique strip hole with the folding pull shaft being movable up and down in the oblique strip hole to unfold and fold the positioning sheets; left and right ends of the folding pull shaft are radially fixed on corresponding left and right side surfaces of the unlocking drawbar; the unlocking drawbar is provided with a notch allowing the positioning sheets to extend out from the side surface of the unlocking drawbar when the positioning sheets are unfolded left and right; through cavities are respectively provided on left and right side surfaces of the guide rod at position corresponding to the notch with the through cavities allowing the positioning sheets to extend out from the side surface of the guide rod after passing through the notch when the positioning sheets are unfolded; a snapping surface of the positioning sheets extending out from the through cavities can snapped with a bottom surface of the sliding seat; left and right side surfaces of the unlocking drawbar located in an upper part of an inner cavity in a middle part of the unlocking drawbar are respectively provided with vertical waist-shaped holes; the horizontal shaft pin is radially inserted and arranged in the waist-shaped holes; a return spring is arranged in an inner cavity of the guide rod below the through cavities; an upper end of the return spring abuts with the unlocking drawbar; a lower end of the return spring and a support rod located in the inner cavity of the guide rod are supported by each other; a upper-lower hole distance of the waist-shaped holes needs to be greater than a maximum distance after the folding pull shaft moves up and down to make the positioning sheets completely folded; a top of the unlocking drawbar is pressed to drive the locking sheets to retract into the inner cavity of the unlocking drawbar so as to be disengaged from the sliding seat; and the pull part is pulled upward to make the sliding seat move downward to perform unlocking.

13. The portable child game bed according to claim 1, wherein the guard bar comprises a left bar body and a right bar body which can be movably connected with tops of corresponding bed legs and a folding part located between the left bar body and the right bar body and capable of folding the left bar body and the right bar body; the folding part comprises a shell body, an elastic positioning body located in a middle part of an inner cavity of the shell body, and a left turning part on a left side of the elastic positioning body and a right turning part on a right side of the elastic positioning body; a right part of the left bar body extends into a left inner cavity of the shell body to be rotationally connected with the shell body; a right end of the left bar body is in transmission connection with the left turning part; the left turning part is connected with a pull rope extending upward from the base of left bed legs; a left part of the right bar body extends into a right inner cavity of the shell body to be rotationally connected with the shell body; a left end of the right bar body is in transmission connection with the right turning part; and the right turning part is connected with a pull rope extending upward from the base of right bed legs.

14. The portable child game bed according to claim 13, wherein each turning part comprises a turning block and a positioning block; a middle part of the turning block is, through a turning block shaft pin, rotationally connected in an inner cavity of corresponding shell body; one end of the turning block is movably connected with one end of the positioning block; the other end of the positioning block is rotationally connected with an end of a corresponding left bar body or right bar body; and the positioning block is provided thereon with a positioning protrusion capable of abutting with the elastic positioning body.

15. The portable child game bed according to claim 14, wherein the positioning block is composed of two positioning sheet bodies in a same shape; the two positioning sheet bodies are symmetrically arranged; one end of a corresponding turning block is clamped between one ends of the two positioning sheet bodies and the one ends of the two positioning sheet bodies can be relatively movably connected together by a rotating shaft; an end of a corresponding left bar body or right bar body is clamped between the other ends of the two positioning sheet bodies and the other ends of the two positioning sheet bodies are mutually rotationally connected together through a sheet body shaft pin; and one end of a corresponding pull rope bypasses an arc-shaped side wall of a corresponding turning block to be connected with the rotating shaft.

16. The portable child game bed according to claim 14, wherein the elastic positioning body comprises compression springs and a compression rod that can abut with the positioning protrusion; the elastic positioning body is provided with two spring cavities for accommodating corresponding compression springs; one ends of the compression springs placed in the spring cavities respectively abut with bottom surfaces of corresponding spring cavities; the other ends of the compression springs respectively abut with a corresponding compression rod; position-limiting waist-shaped through holes are respectively provided on a side wall of the shell body at a position corresponding to the compression springs; the compression rod is inserted and arranged in a corresponding position-limiting waist-shaped through hole; when the guard rod is unfolded, the compression rod and the positioning protrusion on the positioning block can be supported by each other and at this time, a corresponding group of sheet body shaft pin, the rotating shaft, and a turning block shaft pin are located on one straight line from top to bottom, as a line connecting three points; and when the guard rod is folded, the compression rod pushes the positioning protrusion to unlock the rotating shaft, and the positioning block rotates to separate the compression rod from the positioning protrusion.

17. The portable child game bed according to claim 16, wherein a left pull rope spring is connected to the pull rope below the left bar body; one end of the left pull rope spring is connected with an outer end of the pull rope on the left turning block, and the other end of the left pull rope spring is connected together with a transmission mechanism in a corresponding base through the pull rope extending downward to pass through an inner cavity of a left bed leg; a right pull rope spring is connected to the pull rope below the right bar body; and one end of the right pull rope spring is connected with an outer end of the pull rope on the right turning block; the other end of the right pull rope spring is connected together with the transmission mechanism in a corresponding base through the pull rope extending downward to pass through an inner cavity of a right bed leg; and a lowest end of the pull rope connected with the folding part is lower than a position of an extending-in point where the pull rope extends into an inner cavity of a corresponding bed leg.

* * * * *